US007722382B2

(12) United States Patent
Landis et al.

(10) Patent No.: US 7,722,382 B2
(45) Date of Patent: May 25, 2010

(54) WIRE RETENTION CONNECTOR SYSTEM

(75) Inventors: John Michael Landis, Camp Hill, PA (US); David James Fabian, Mount Joy, PA (US); Christopher George Daily, Harrisburg, PA (US); Timothy Lee Kocher, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 565 days.

(21) Appl. No.: 11/675,981

(22) Filed: Feb. 16, 2007

(65) Prior Publication Data

US 2008/0108246 A1 May 8, 2008

Related U.S. Application Data

(63) Continuation-in-part of application No. 11/555,941, filed on Nov. 2, 2006, now Pat. No. 7,488,196.

(51) Int. Cl.
*H01R 13/58* (2006.01)

(52) U.S. Cl. ..... 439/393; 439/441; 439/942; 439/948

(58) Field of Classification Search ..... 439/456–459, 439/942, 393, 441
See application file for complete search history.

(56) References Cited

U.S. PATENT DOCUMENTS

| | | | | |
|---|---|---|---|---|
| 1,254,703 | A * | 1/1918 | Klein | 439/457 |
| 3,336,567 | A * | 8/1967 | Coldren | 439/685 |
| 3,452,150 | A * | 6/1969 | Gazzoli | 174/87 |
| 3,993,391 | A | 11/1976 | Vernerey et al. | |
| 5,352,854 | A | 10/1994 | Comerci et al. | |
| 5,536,103 | A * | 7/1996 | Sawada | 403/326 |
| 6,019,645 | A * | 2/2000 | Avery et al. | 439/752 |
| 6,129,583 | A * | 10/2000 | Lok | 439/545 |
| 6,302,724 | B1 | 10/2001 | Meller | |
| 6,443,765 | B2 * | 9/2002 | Ichio et al. | 439/587 |
| 6,719,581 | B2 * | 4/2004 | Kikuchi | 439/441 |
| 6,746,286 | B2 | 6/2004 | Blaha | |
| 2002/0019176 | A1 | 2/2002 | Sasaki et al. | |
| 2008/0108241 | A1 | 5/2008 | Kocher et al. | |

FOREIGN PATENT DOCUMENTS

| | | |
|---|---|---|
| WO | WO 2006/131607 | 12/2006 |

OTHER PUBLICATIONS

LM-2x Specification; CONNECTsystem for LINEARlight; from OSRAM; 3 pages.

* cited by examiner

*Primary Examiner*—Neil Abrams

(57) ABSTRACT

A wire retaining connector, connector system and method of connecting wires to connectors to reduce or eliminate unintentional wire disconnection from wire connectors, including disconnection of poke-in connectors. The connectors and connector systems include a connector body having at least one opening configured to receive a wire, the wire including a partially exposed conductor and insulation. The connector body further includes a wire retention member having at least one surface onto which a wire may be engaged. A cutting projection may also be provided on the wire connector to form a channel in the insulation during insertion of the wire into the connector. The wire retention member or the projection provides sufficient retention of the wire to resist disconnection of the wire from the connector body. A method for connecting wires to the connectors is also provided.

19 Claims, 42 Drawing Sheets

WIRE RETENTION CONNECTOR SYSTEM

CROSS-REFERENCE TO RELATED APPLICATIONS

This application is a continuation in part of, and claims priority to, U.S. patent application Ser. No. 11/555,941 having a filing date of Nov. 2, 2006 now U.S. Pat. No. 7,488,196, and which is hereby incorporated by reference in its entirety.

FIELD OF THE INVENTION

The present invention is directed to a wire connector, wire connector system and a wire connecting method for providing connection of one or more wires to a connector. In particular, the present invention is directed to a wire connector, wire connector system and a wire connecting method that provides poke-in connections to connectors that substantially resist unintentional disengagement from pulling and/or twisting of the wires.

BACKGROUND OF THE INVENTION

Wire terminals are well known in the connector industry. Typically, the terminals include a pin and mating socket, together with a conductor connecting portion. In the event that the terminals are connected to wires, the terminals include a wire connecting section. One such form of wire connecting section is the wire crimp, where the wire is stripped and placed in a terminal end, and then crimped in place where the metal deforms about the conductor to form the electrical connection.

It is desirable in certain applications to not require a crimped connection. Typically, this is in the situation where the wires are stripped on site, and where crimping tools are not readily available. An example of such a situation would be in the lighting industry where overhead lights are installed, and it is easier for the installer to not require a crimped connection.

Currently, electrical wires are attached to plug-in connectors by inserting an end of the wire into an opening of the connector where the wire is engaged by a force to hold or lock the wire into place. Particularly desirable is a poke-in connector, wherein an insulated wire, particularly a wire having a portion of the insulation removed, is inserted into a connector and the connector engages the wire therein. This engagement of the wire may be by a lance, tab, spring or other compressive mechanism within the connector.

If the wire is pulled and/or twisted while engaged with the connector, the wire may become disconnected from the connector resulting in a loss of electrical connection. In addition, the disconnected wire may be electrically hot, particularly during installation or maintenance. The disconnection results from forces resulting from pulling and/or twisting of the wires in a manner that exceeds the force retaining the wires within the connector, allowing the wire to deform and slip from the connector. In particular, the twisting or rotation of the wire significantly reduces the amount of force required to disengage the wire from the connector. The contact engagement effectively cuts helical threads into the conductor during rotation, resulting in an unscrewing of the conductor from the connector.

Therefore, what is needed is a system that provides strain relief and/or reduces or eliminates unintentional release of wires from plug-in connectors when the wire is being pulled and twisted or rotated.

SUMMARY OF THE INVENTION

The present invention is directed to a wire retaining system that substantially prevents unintentional disengagement of wires inserted into connectors due to pulling and/or twisting or rotating the wires. In particular, the present invention permits a poke-in connection of insulated wires reducing or eliminating wires unintentionally disengaging from the connector.

One aspect of the present invention includes a wire retaining connector having a connector body having at least one opening configured to receive a wire. The wire includes a partially exposed conductor and insulation. The connector body includes a wire retention member having at least one slot into which a portion of the wire may be positioned. The positioning of the portion of the wire provides at least one bend in the wire sufficient to resist rotation and disconnection of the wire from the connector body.

Another aspect of the invention includes a wire retaining connector having a connector body with at least one opening configured to receive a wire. The wire includes a partially exposed conductor and insulation. The connector body further includes a wire retention member having at least one channel into which a portion of the wires may be positioned. The positioning of the portion of the wires provides a bend in the wire sufficient to resist rotation and disconnection of the wire from the connector body.

Still another aspect of the invention includes a wire retention connector system having a first connector body and a second connector body. Each of the first and second connector bodies have at least one opening configured to receive a wire. The wire including a partially exposed conductor and insulation. The connector body further includes a wire retention member having at least one surface onto which a portion of the wires may be positioned. The positioning of the portion of the wires provides at least one bend in the wire sufficient to resist rotation and disconnection of the wire from the connector body. The first connector body and the second connector body also include features that disengagably connect the first connector body to the second connector body.

Still another aspect of the invention includes a method for providing a connector with resistance to wire disconnection. A connector is provided having a connector body having at least one opening configured to receive a wire. The wire includes a partially exposed conductor and insulation. The connector body further includes a wire retention member having at least one surface onto which a wire may be engaged. The surface is a channel or a slot. The wire is inserted into the connector body in a direction substantially along an axis. At least a portion of the wire is oriented at an angle to the axis wherein the orienting further includes positioning the wire adjacent to the at least one surface of the wire retention member.

An advantage of an embodiment of the present invention is that a "poke-in" connection may be utilized wherein special tools and/or crimping are not required.

Another advantage of an embodiment of the present invention is that connector systems for connecting a plurality of wires, including six or more wires, may be provided.

Another advantage of an embodiment of the present invention is that the connector is compact taking up a small amount of space and wherein a reduced amount of material is required and may be configured for a plurality of wires, including six or more wires.

Another advantage of an embodiment of the present invention is that the wires are sufficiently engaged with the connector to substantially prevent the unintentional disengagement of the wires from the connector.

Still another advantage of an embodiment of the present invention is that the connectors are easily manufactured.

Still another advantage of an embodiment of the present invention is that the connectors resist wire twisting and inadvertent unscrewing of the wires from the connector, wherein the rotation of the wires is minimized or eliminated, increasing the force required to disengage the wires from the connector.

Still another advantage of an embodiment of the present invention is that the connectors provide improved wire dress and/or wire management.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers are used throughout the drawings to refer to the same or like parts.

DETAILED DESCRIPTION OF THE INVENTION

Figure 1:
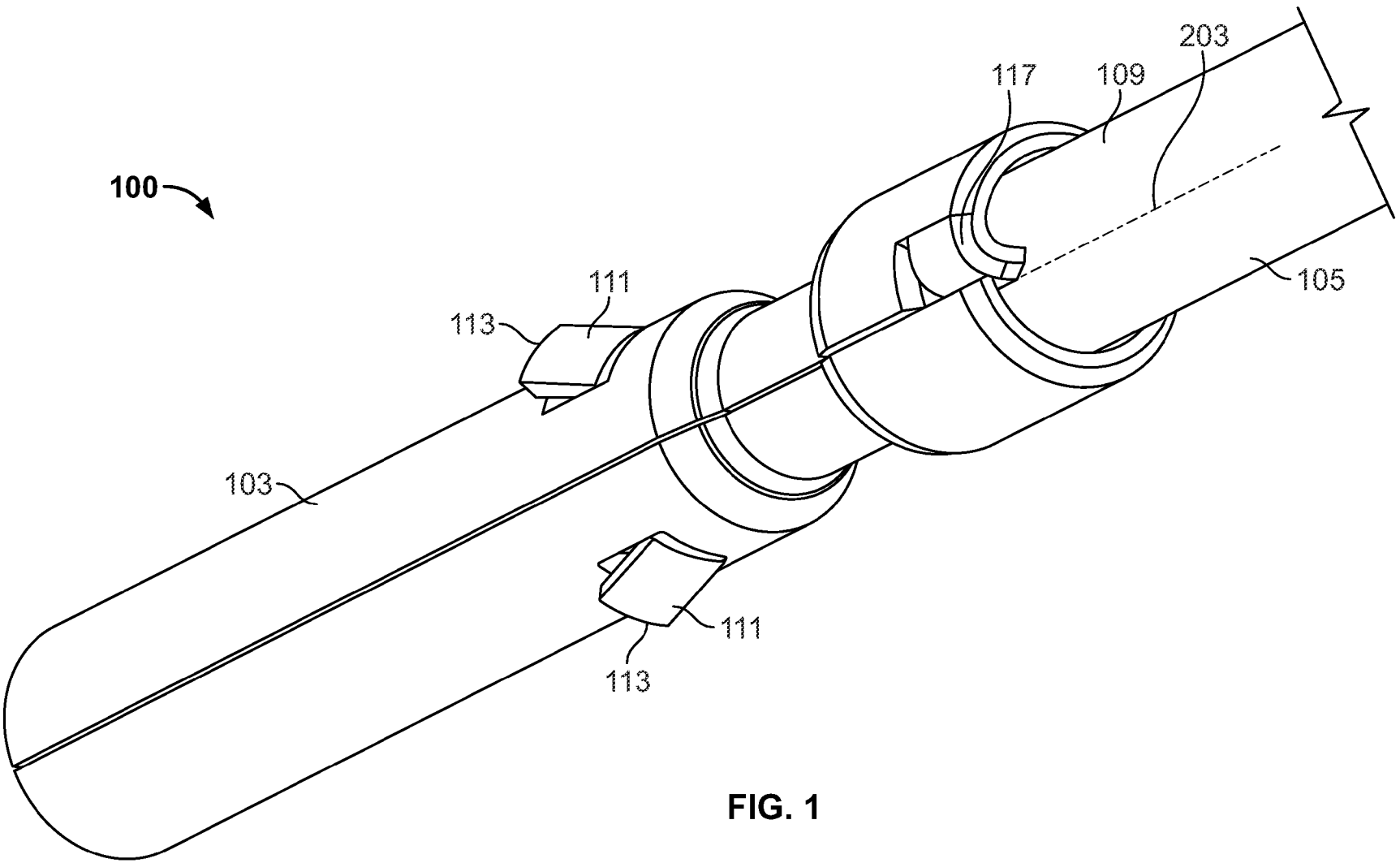
FIG. 1 illustrates a perspective view of a wire terminal and wire according to an embodiment of the present invention.

The present invention includes an embodiment of a wire retaining system for providing resistance against unintentional disengagement of wires inserted therein. In particular, the present invention allows the use of poke-in connections wherein wires may be engaged with the connectors without the use of crimping or special tools. FIGS. 1-4 show an embodiment of a wire retaining system having an wire terminal 100 that is configured to be locked into connector housing 400 (see FIG. 4) and to lockingly receive electrical wire 105. Electrical wire 105 includes conductor 107 and insulation 109. The configuration of wire 105 may be any configuration of wire that includes an insulated conductive portion. Suitable wires 105 include, but are not limited to, 18-gauge solid-core copper wire. Wire terminal 100 includes a terminal body 103, a locking portion or member 111, defining a locking shoulder 113 for engaging a surface of a connector housing 400 (see, e.g., FIG. 4) to securely retain wire terminal 100 within connector housing 400.

Figure 2:
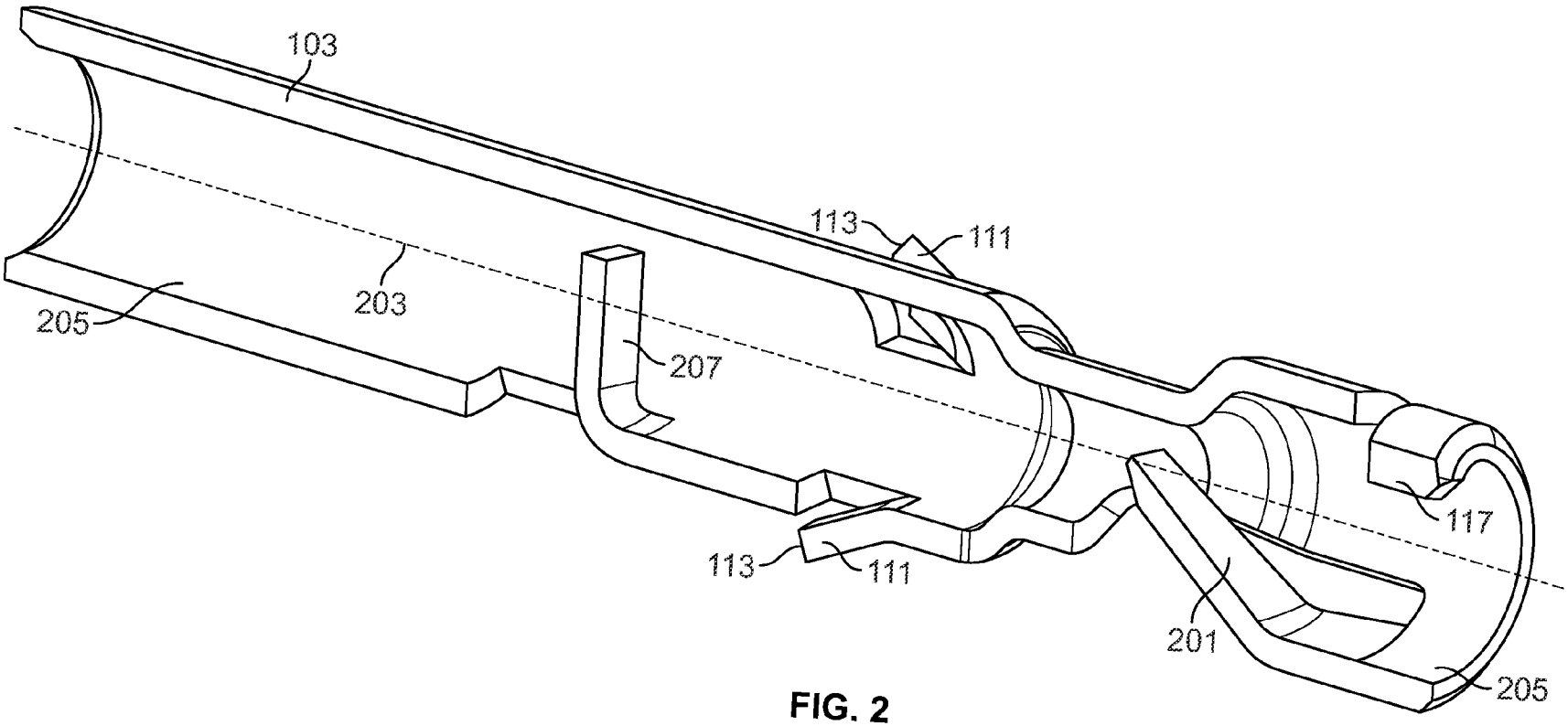
FIG. 2 illustrates a perspective cross-sectional view of a wire terminal according to an embodiment of the present invention.

As best viewed in FIG. 2, terminal body 103 further includes a contact gripping element 201 arranged extending into an aperture 205 within terminal body 103. Terminal body 103 further includes a stop 207 in electrical communication with terminal body 103 that provides a surface onto which a conductor 107 may abut to establish a maximum insertion of wire 105 (see, e.g., FIG. 3) inside terminal body 103. Stop 207 may be formed from terminal body 103 or may be attached to the terminal body 103. The contact gripping element 201 may be cut or stamped out from terminal body 103, but as shown, is stamped from a blank of material from which it is formed. Alternatively, contact gripping element 201 may be separately provided and secured to terminal body 103. In this embodiment, wire terminal 100 is of unitary construction. Contact gripping element 201 may be resiliently biased into the form of, for example, a leaf spring or beam structure. The contact gripping element 201 defines a wire trap for contacting an exposed conductor of an insulated wire or a conductor of an uninsulated wire or an electrically conductive contact having a similar cross-section. In the embodiment shown in FIGS. 1-4, the wire terminal 100 further includes a blade 117 extending inwardly from the terminal body 103 into aperture 205 toward a terminal center axis 203.

Figure 3:
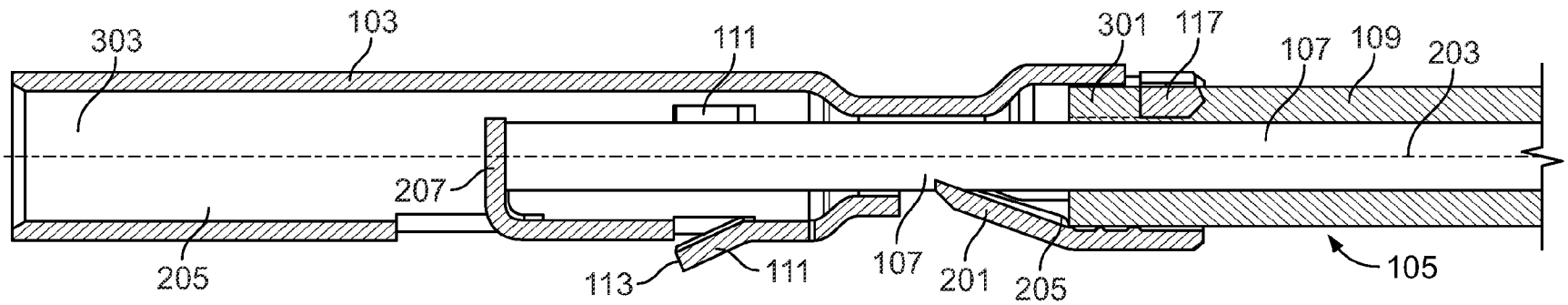
FIG. 3 illustrates an elevational cross-sectional view of a wire terminal and wire according to an embodiment of the present invention.

As shown in FIGS. 1 and 3, conductor 107 of wire 105 is installed in wire terminal 100 by directing conductor 107 along terminal center axis 203 post blade 117 toward end 303 until conductor 107 abuts stop 207. Stop 207 is shown as a tab that is biased inwardly into aperture 205. However, stop 207 may also include a region of reduced cross-sectional area to provide a surface to abut conductor 107 when fully inserted inside aperture 205.

As best shown in FIG. 1, blade 117 preferably extends toward terminal center axis 203 perpendicularly to terminal center axis 203. The extension of the blade 117 toward terminal center axis 203 is preferably such that the blade 117 contacts the insulation 109 of wire 105 inserted in terminal 100. This contact is such that the blade 117 slices or shears a groove or channel 301 (see FIGS. 3-4) in the insulation 109 during insertion of the wire 105 into the terminal with the channel 301 providing an engagement with the wire 105 to substantially prevent axial rotation between the wire 105 and the wire terminal about terminal center axis 203. The blade 117 may also include a tapered edge (not shown) arranged parallel to terminal center axis 203 to reduce the force associated with inserting wire 105 and forming channel 301. The position of blade 117 may be any circumferential position on terminal body 103 that permits extension of blade 117 toward wire 105. That is, blade 117 may extend into aperture 205, but not necessarily aligning with terminal center axis 203. The extension of blade 117 may provide a channel 301 in the insulation 109, the conductor 107 or any combination thereof. In one embodiment of the invention, the blade 117 may be incorporated into contact gripping element 201 wherein the channel 301 is formed on the conductor 107. In addition, a plurality of blades 117 may be utilized to further resist wire rotation.

Figure 4:
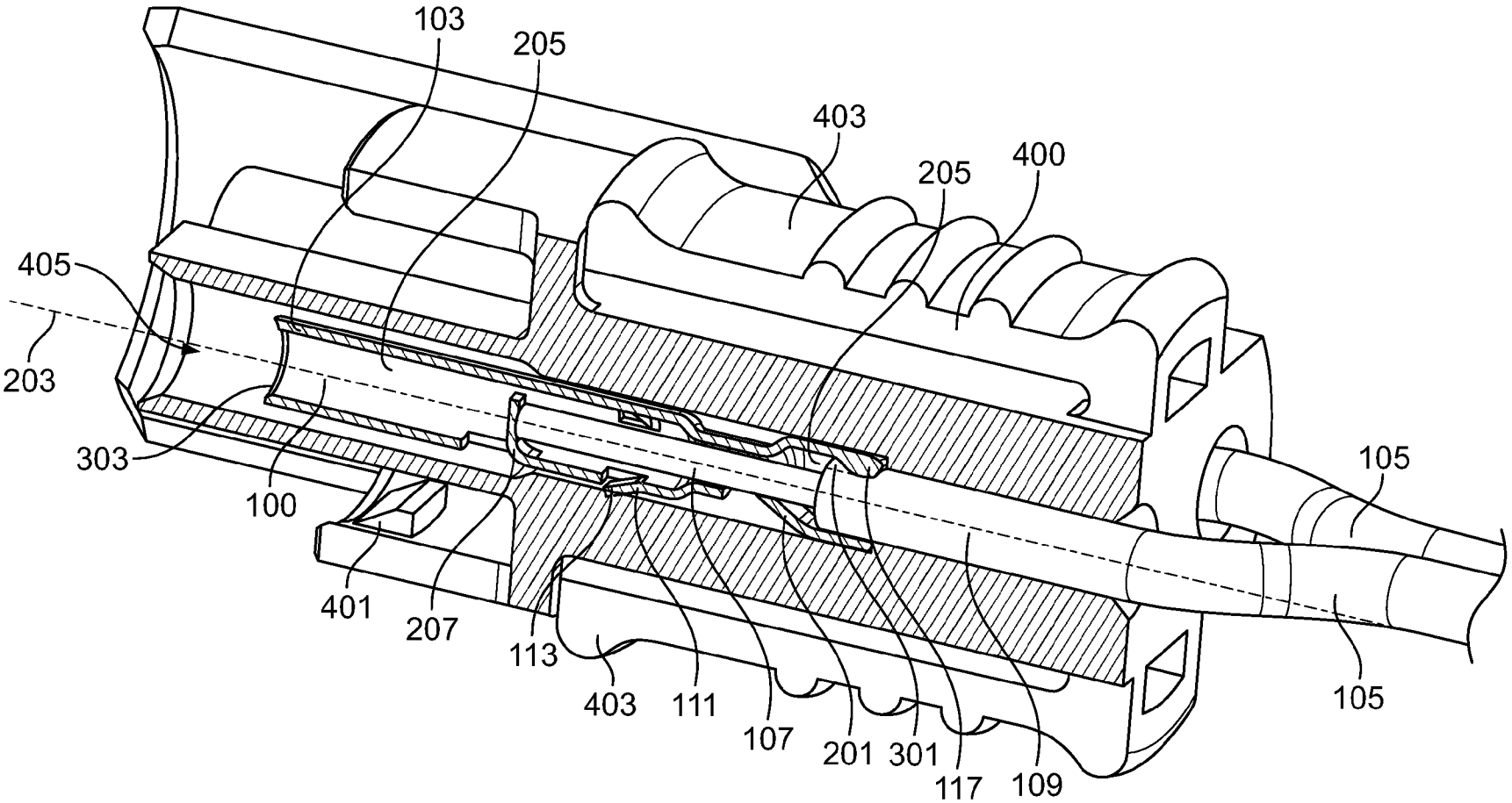
FIG. 4 illustrates a perspective cross-sectional view of a wire terminal according to an embodiment of the present invention mounted in a connector housing.

FIG. 4 shows a cross-sectional view of a connector housing illustrating a wire terminal 100 according to an embodiment of the present invention arranged within the connector housing 400, with a portion of the connector housing 400 removed. Locking member 111 at the locking shoulder 113 engages surface of the connector housing 400 to substantially prevent disengagement of the wire terminal 100 from the connector housing 400. Connector housing 400 may be configured in any manner that mates a second connector housing (see, e.g., FIG. 13), wherein each of the connector housing 400 and wire terminal 100 receives and engages a conductor 107 of a wire 105 for electrical connection of wires 105 to the second connector. Connector housing 400 is preferably fabricated from a non-electrically conductive material, such as, for example, conventional engineering grade thermoplastic. As shown in FIG. 4, the connector housing 400 and the wire terminal 100 are configured as a female connection via aperture 205 at end 303 for receiving a male plug. While wire terminal 100 is shown as including a female connection at end 303, the wire terminal 100 may include a male plug at end 303 or any other structure that permits electrical communication between engaged connector housings. The connector housings 400 may be engaged in any suitable manner, including but not limited to, disenagable latches 401 that are disengagable by depressing latch arms 403. Mating connector housings (not shown in FIG. 4) may include latch features 1301 (see, e.g., FIG. 13) that engage latches 401 and substantially prevent disengagement of the connector housings 400. In addition, connector housing 400 includes opening 405 that may have mating geometries that permit orientation of mating plugs only in desired configurations. Engagement of connector housings 400 and their corresponding wire terminals 100 permits safe and easy electrical connection/disconnection of wires 105 without the necessity of crimping, special tools or equipment. As shown in FIG. 4, a plurality of wires 105 may be inserted into connector housing 400, wherein the arrangements of corresponding wire terminals 100 may be the same or different than the arrangement shown in FIG. 4.

The engagement of blade 117 with rotation resistance is achieved by formation of channel 301, wherein channel 301 has sufficient depth into insulation 109 and/or conductor 107 to provide substantial resistance to rotation about terminal center axis 203. While it is preferable to provide channel 301 into the insulation 109 only, the channel 301 may also be formed into conductor 107. This rotational resistance allows the wire 105 engaged or trapped by contact gripping element 201 to remain engaged and substantially prevents unintentional disengagement of wire 105 due to rotation and pulling of wire 105 about terminal center axis 203. Additional blades 117 provide additional rotational resistance, but also increase the amount of force required to insert wire 105.

Figure 5:
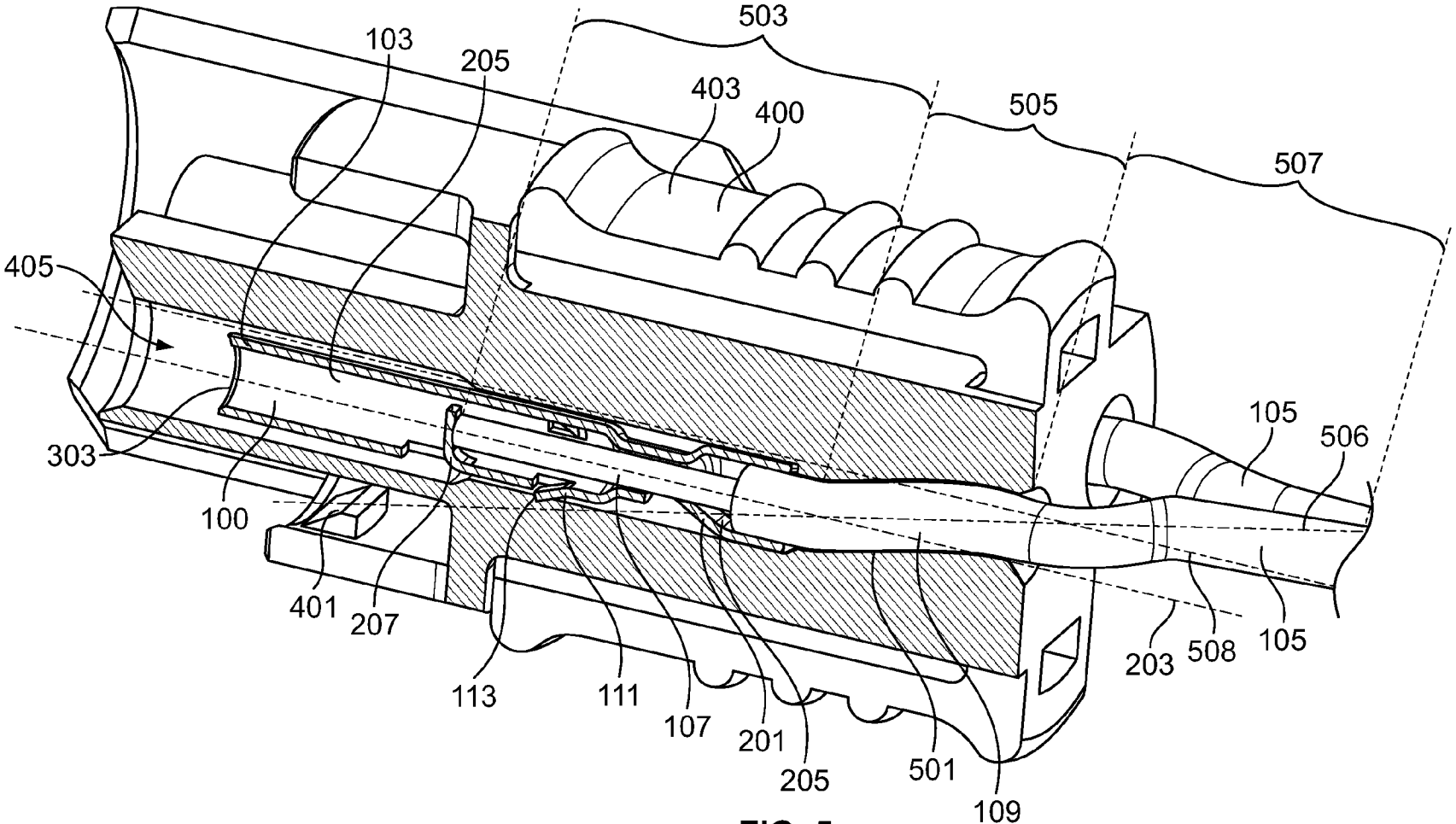
FIG. 5 illustrates a perspective cross-sectional view of a connector housing and wire according to an embodiment of the present invention.

FIG. 5 shows a cross-sectional view of another embodiment of the present invention with a portion of the connector housing 400 removed, including a wire terminal 100 according to an embodiment of the present invention arranged within connector housing 400. The embodiment shown in FIG. 5 includes substantially the same arrangement of connector housing 400 and wire terminal 100 substantially as shown and described in FIG. 4. The wire terminal 100 in the embodiment shown in FIG. 5 may or may not include blade 117. However, connector housing 400 further includes an angle channel 501 configured to conform wire 105 (i.e., bend) in a plurality of axes, including axes different than terminal center axis 203. During insertion of conductor 107 into connector housing 400, the wire is directed along angle channel 501 in a direction at an angle to terminal center axis 203. As the conductor 107 is further inserted toward end 303 and past angled channel 501, the conductor 107 is directed along terminal center axis 203. Upon full insertion of conductor 107, the wire 105 and conductor 107 are configured into at least a first wire orientation section 503 which is oriented substantially parallel to and/or coincident with about the terminal center axis 203, a second wire orientation section 505 which is oriented substantially parallel to and/or coincident with about an angle channel axis 506 and a third wire orientation section 507, which is oriented substantially parallel to and/or coincident with about a front opening axis 508. While the above has been described as three axes, the orientation of the inserted wire 105 may include greater than three axes and may include curved, rounded or twisted orientations along the angle channel 501 or exterior to the connector housing 400. As shown in FIG. 5, a plurality of wires 105 may be inserted into connector housing 400, wherein the arrangements of corresponding wire terminals 100 and the presence and arrangement of angle channel 501 may be the same or different than the arrangement shown in FIG. 5. For example, angle channel 501 may include multiple orientations for directing wire 105 into a plurality of directions. Likewise, the angle channel 501 may be oriented at any angle or direction that provides an angle to terminal center axis 203. This embodiment of the present invention permits the easy engagement of wire 105 while reducing or eliminating undesired/unintentional disengagement of wire 105 from the wire terminal 100 and/or the connector housing 400.

Figure 6:
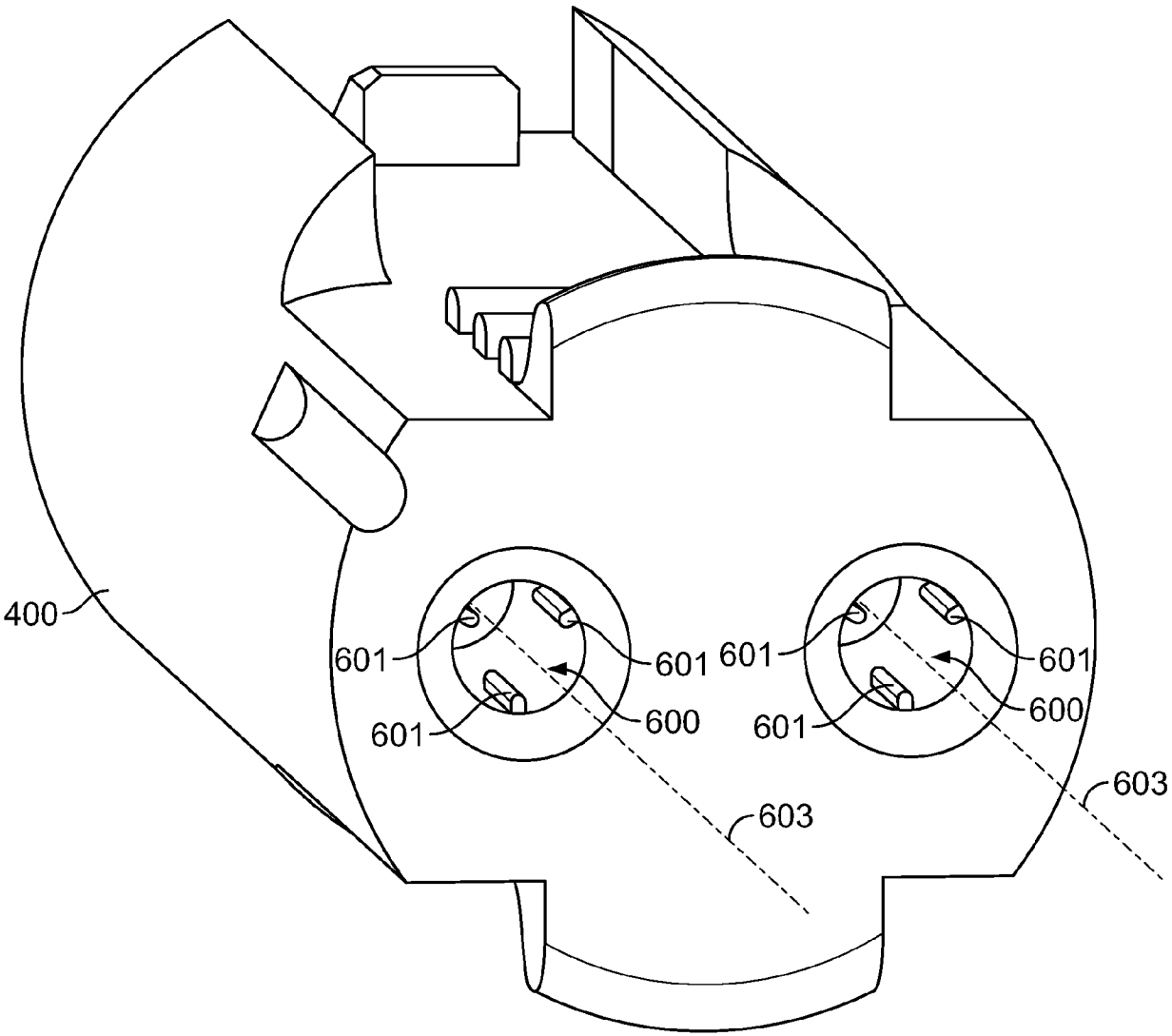
FIG. 6 illustrates a perspective view of a connector housing according to another embodiment of the present invention.

FIG. 6 illustrates a wire retaining system according to another embodiment of the present invention, including a connector housing 400 having openings 600 configured to receive wires 105 (not shown in FIG. 6). Circumferentially about a surface of opening 600, at least one rib 601 is configured to receive wire 105. Preferably ribs 601 are configured to engage the insulation 109 of wire 105. The ribs 601 may be of certain construction with the connector housing 400 or may be attached to opening 600. The ribs 601 are preferably a non-conductive material of sufficient rigidity and having a geometry that grips the insulation 109 and resists or prevents rotation of wire 105 when wire 105 is inserted rotationally about opening center axis 603. In another embodiment of the invention, a conductive material, such a metal may be utilized in the connector housing 400 or as insert thereto, forming ribs 601 for gripping wire 105. The ribs 601 may be oriented at an angle to opening center axis 603 or perpendicular to opening center axis 603. In other words, ribs 601 may or may not radially extend in alignment with opening center axis 603. In addition, ribs 601 preferably sufficiently engage insulation 109 that the resistance to undesired/unintentional disengagement parallel to opening center axis 603 is likewise increased. As shown, ribs 601 are arranged substantially parallel to the opening center axis 603 of opening 600.

Figure 7:
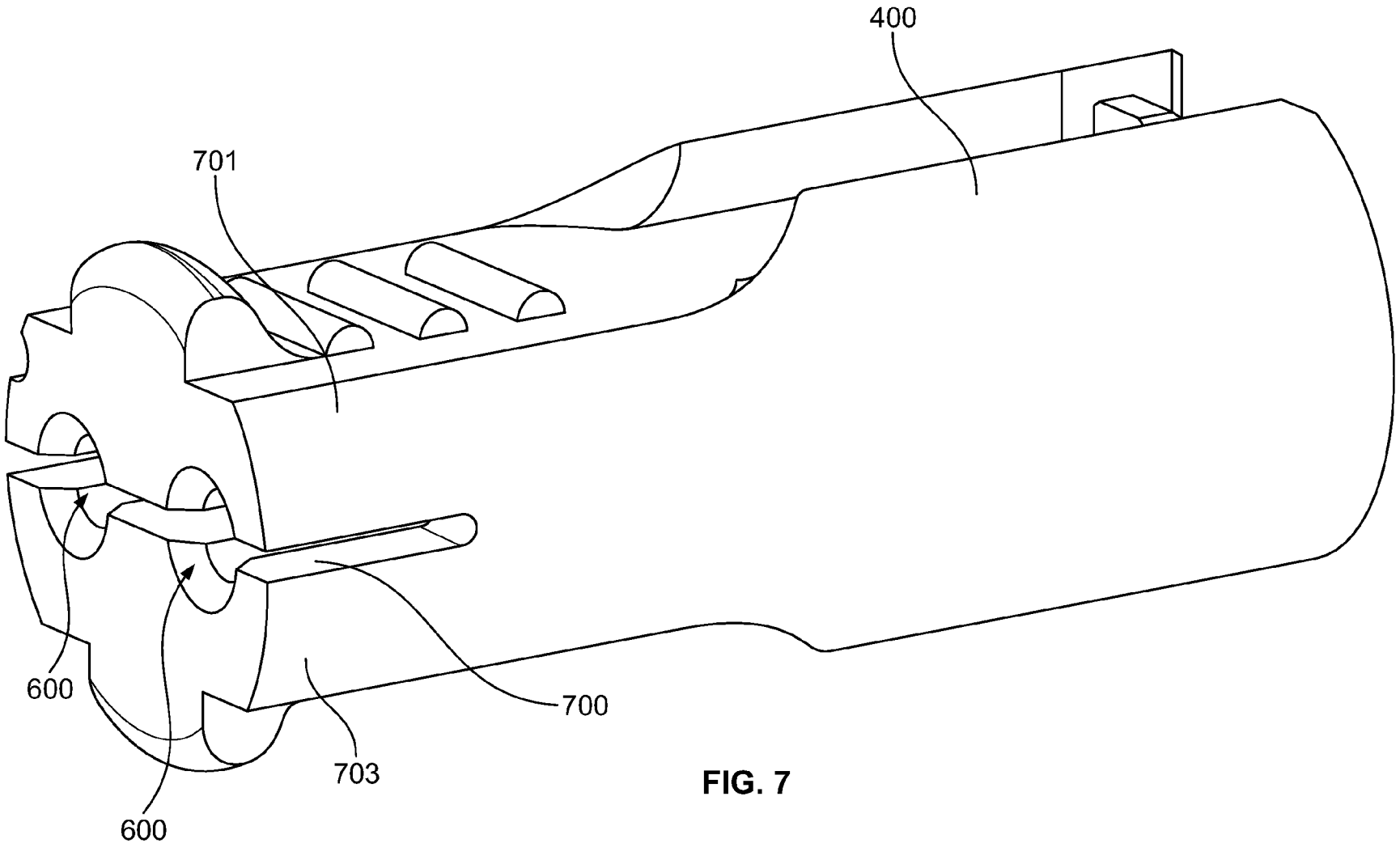
FIG. 7 illustrates a perspective view of a connector housing according to still another embodiment of the present invention.

FIG. 7 illustrates a wire retaining system according to another embodiment of the present invention, including a connector housing 400 having openings 600 configured to receive wires 105 (not shown in FIG. 7). Openings 600 may include ribs 601, as shown and described above with respect to FIG. 5, and/or the connector housing 400 may include wire terminal 100 structures, as described above with respect to FIGS. 1-5. The connector housing 400 of this embodiment of the invention further includes a segmenting slot 700 extending through both openings 600 and through the connector housing 400. The segmenting slot 700 is formed into the connector housing 400 coplanar to a center axis of the wire 105 and provides a compliant force on an insulation portion of the wire 105 by segmenting portions of the connector body into pivoting portions. Segmenting slot 700 forms a pivotable top member 701 and a pivotable bottom member 703. Pivoting of top member 701 and bottom member 703 preferably is facilitated by elastic deformation of the material making up connector housing 400 but may be provided by an attached mechanical or formation of a hinge or hinge-like structure. The pivoting of the top member 701 and/or the bottom member 703 decreases the resistance (i.e., force required for insertion) on the wire 105 (not shown in FIG. 7) by allowing a reduced force on wire 105 due to contact with top member 701 and bottom member 703 and structures, such as ribs 601, extending inwardly along openings 600. The reduced resistance to insertion permits the utilization of additional wire retention structures, such as blade 117, contact gripping element 201 and ribs 601, and other structures that increase resistance to electrical wire 105 insertion, into connector housing 400. This embodiment of the present invention permits the simple and easy engagement of wire 105 while permitting the use of wire retention structures to reduce or eliminate undesired/unintentional disengagement of wire 105 from the wire terminal 100 and/or the connector housing 400.

Figure 8:
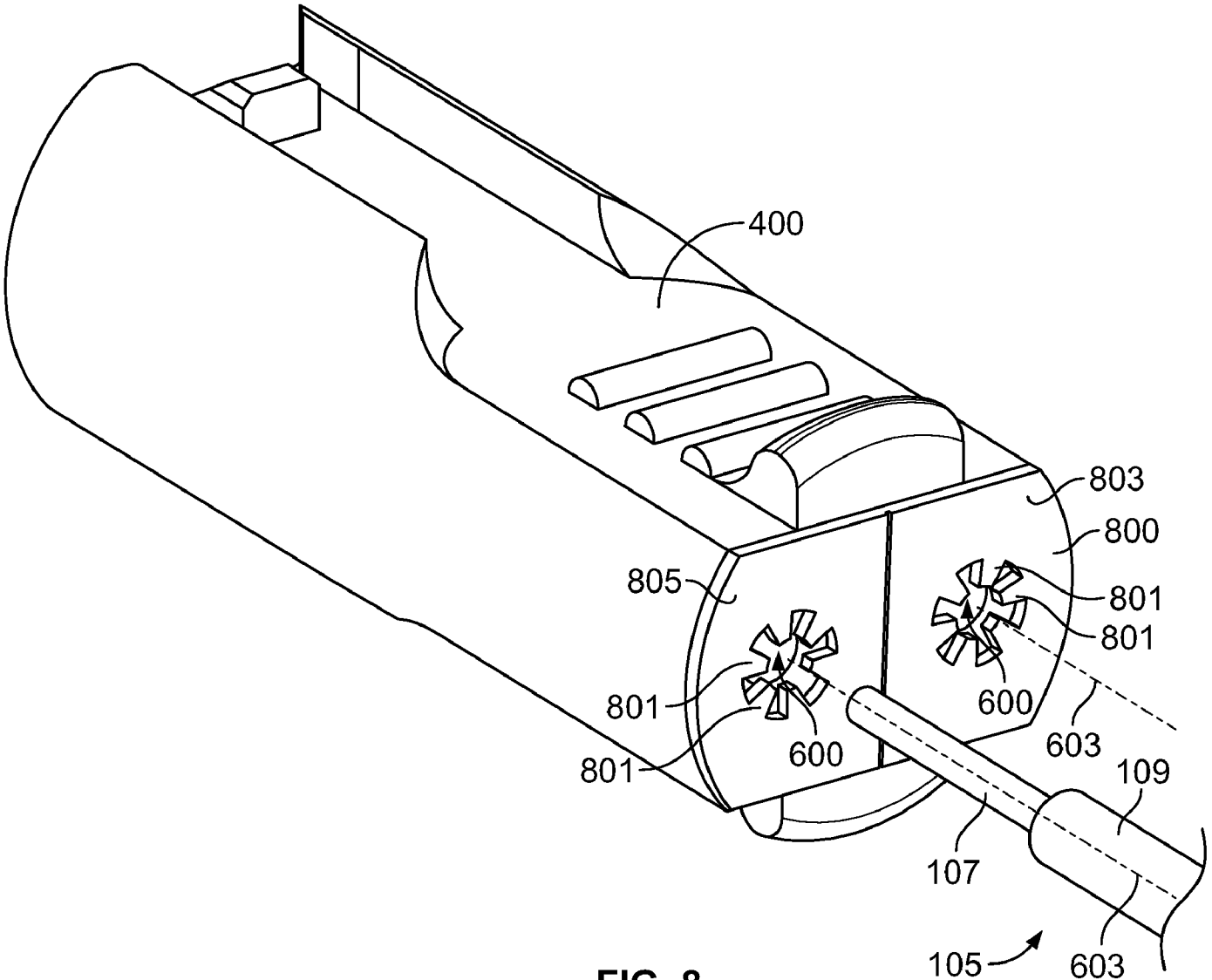
FIG. 8 illustrates a perspective view of a connector housing according to still another embodiment of the present invention.

FIG. 8 illustrates a wire retaining system according to another embodiment of the present invention, including a connector housing 400 having openings 600 configured to receive wires 105. Connector housing 400 may include wire terminal 100 structures (not shown in FIG. 8) and/or ribs 601 to provide wire retention, as described above with respect to FIGS. 1-6. However, the embodiment shown in FIG. 8 further includes a retention plate 800 having openings 600 configured to allow insertion of wire 105. In addition, the periphery of opening 600 includes a plurality of fingers 801 extending inward toward the opening center axis 603 of opening 600. These fingers 801 are configured to grip the insulation 109 of wire 105 and provide resistance against unintentional disengagement of wire 105 in response to a pulling and/or twisting force directed along opening center axis 603. Plate 800 is preferably a non-electrically conductive material, such as a polymeric material that is sufficiently rigid to provide resistance in response to pulling and/or twisting forces directed along opening center axis 603. For example, plate 800 may be fabricated from a mylar film. Plate 800 is preferably attached to a surface of connector housing 400. Plate 800 may be attached to connector housing 400 in any conventional manner, including, but not limited to adhesives or thermal bonding. However, plate 800 may also be fabricated as a unitary piece with connector housing 400. In addition, plate 800 may be partitioned into a first plate segment 803 and a second plate segment 805, wherein each plate segment may be provided with color, marking or other indicia to indicate proper installation and/or configuration of wires 105. The addition of plate 800 to the connector housing 400 provides resistance against undesirable/unintentional disengagement of wire 105 in response to a pulling force directed along opening center axis 603.

Figure 9:
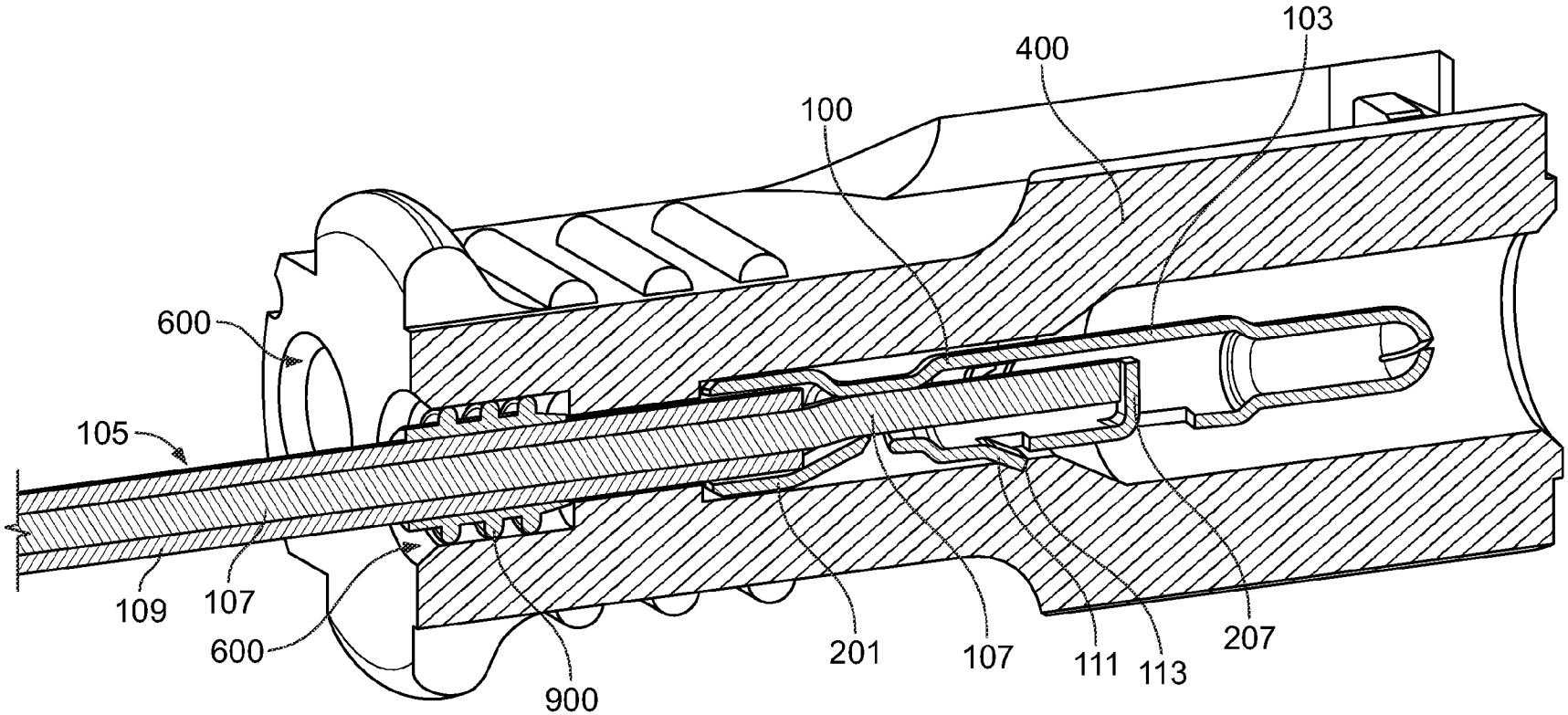
FIG. 9 illustrates an elevation cross-sectional view of a connector housing according to still another embodiment of the present invention.

FIG. 9 illustrates a wire retaining system according to still another embodiment of the present invention, including a connector housing 400 having wire terminal 100 incorporated therein. The embodiment shown in FIG. 9 includes substantially the same arrangement of connector housing 400 and wire terminal 100 substantially as shown and described in FIG. 4. The wire terminal 100 in the embodiment shown in FIG. 5 may or may not include blade 117. Opening 600 is formed into connector housing 400, wherein opening is configured to receive a gripping structure or grommet 900. Grommet 900 includes a non-electrically conductive material, such as a polymeric or rubber material, which grip and/or apply frictional sliding resistance to wire 105 and/or connector housing 400. The grommet 900 may be incorporated into connector housing 400 or may be attached or installed onto wire 105. The grommet 900 may also utilize an adhesive, such as a pressure sensitive adhesive to further grip wire 105 and provide additional resistance in response to pulling and/or twisting. The grommet 900 preferably provides sufficient frictional sliding resistance to substantially prevent undesirable/unintentional disengagement of wire 105 from wire terminal 100 and/or connector housing 400.

Figure 10:
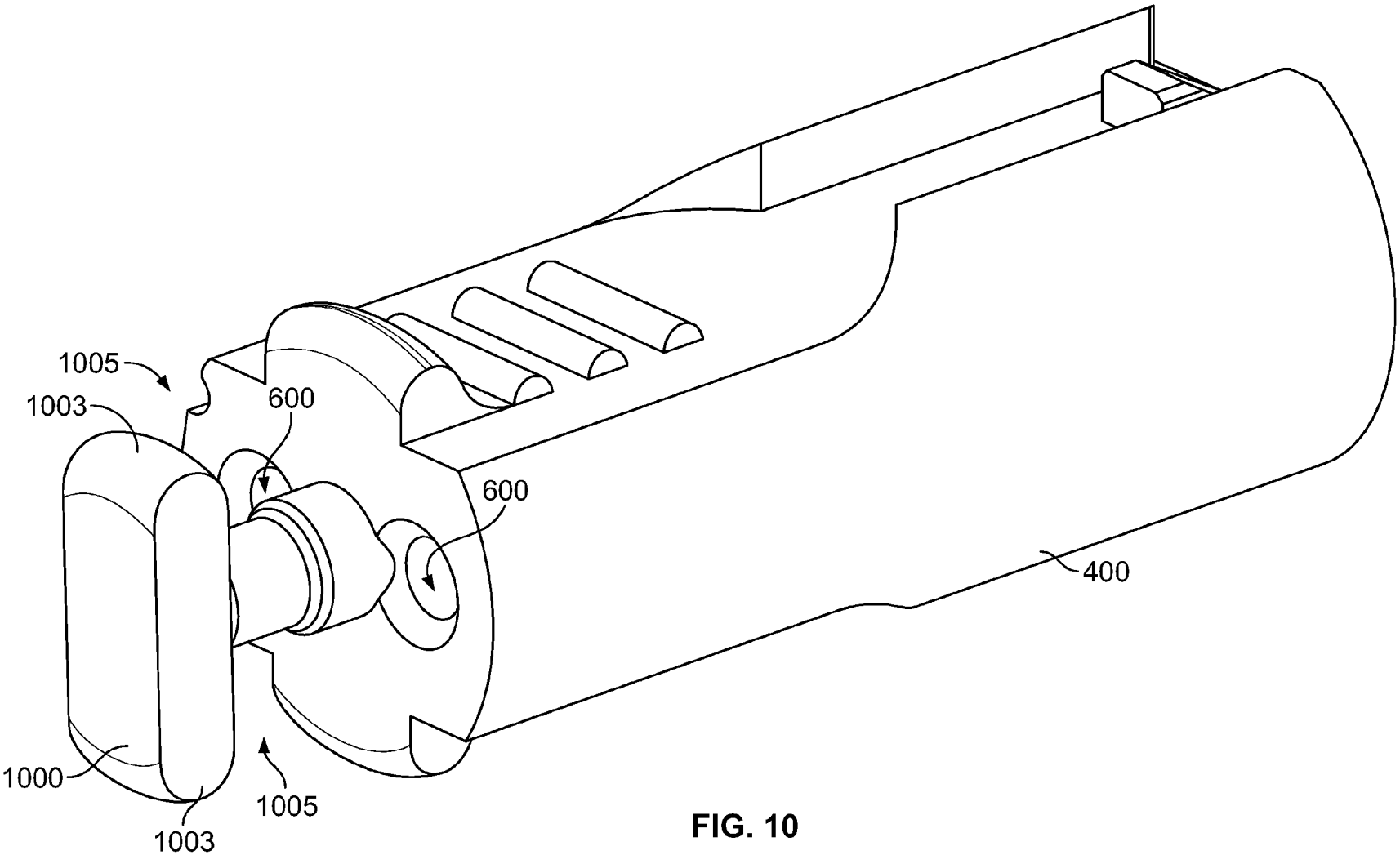
FIG. 10 illustrates a perspective view of a connector housing according to still another embodiment of the present invention.

FIG. 10 illustrates a wire retaining system according to still another embodiment of the present invention, including a connector housing 400 having wire terminal 100 (not shown in FIG. 10) incorporated therein for receiving a wire 105 (not shown in FIG. 10). Connector housing 400 further includes a retention member 1000, which extends from connector housing 400. Retention member 1000 includes a "T" shape, wherein arms 1003 extend to form a slot 1005 between arms 1003 and connector housing 400. Slot 1005 has a geometry permitting the insertion of a wire or cable tie 1201 (see e.g., FIG. 12), or other device capable of substantially immobilizing wires 105. Cable tie 1201 may be inserted into slot 1005, wherein the wire retention structure provides surfaces that prevent the cable tie 1201 from slipping or moving in a direction away from connector housing 400. The cable tie 1201 also provides wire retention by providing a sufficient circumferential force inward toward retention member 1000 to retain wires 105 adjacent to retention member 1000 and substantially prevent undesirable/unintentional disengagement of wire 105 from wire terminal 100 and/or connector housing 400. In addition, wire 105 may be oriented around (i.e., wrapped around) wire retention member 1000 in a manner that provides orientation of wire 105 in a plurality of axes and provides additional resistance to pulling and/or twisting.

Figure 11:
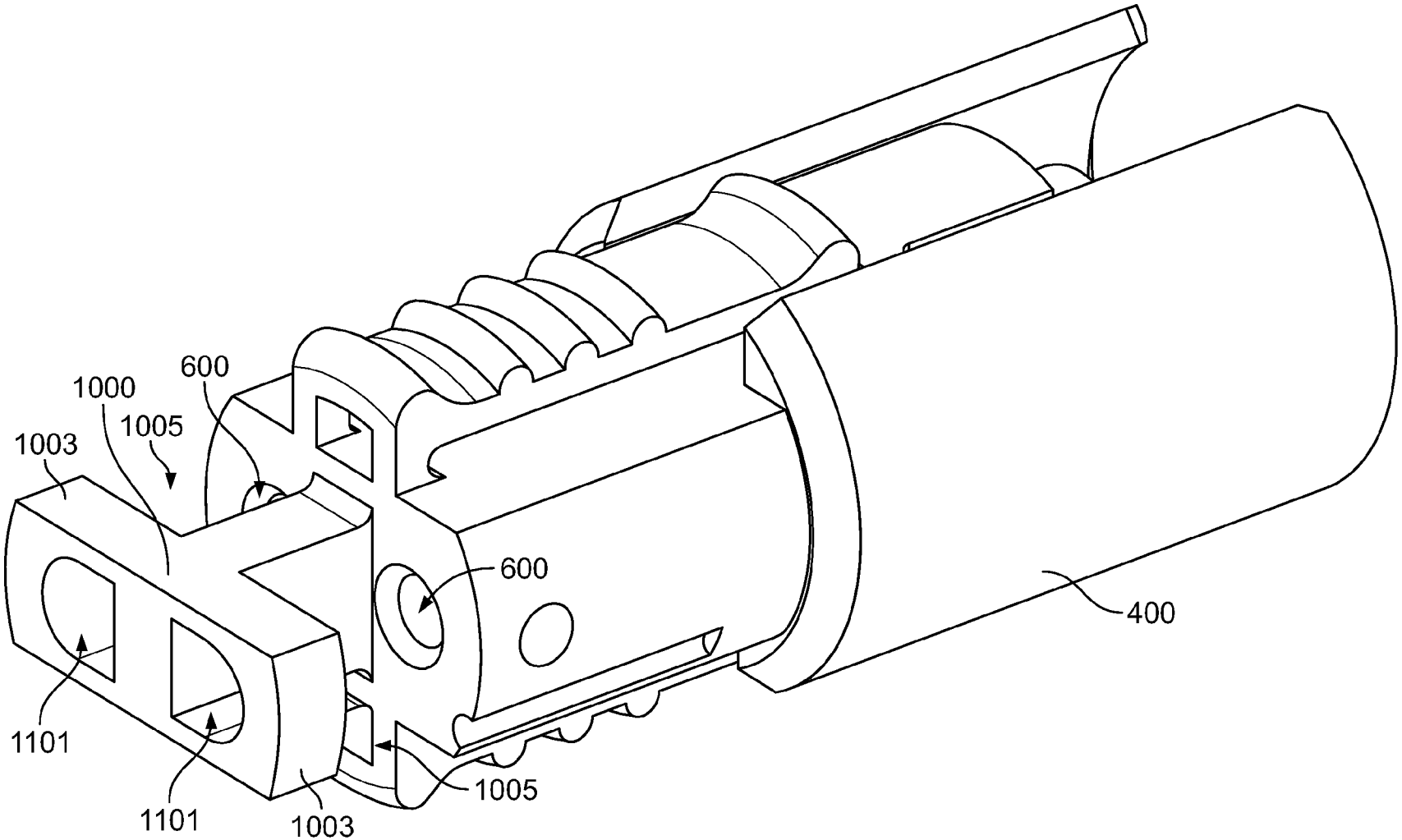
FIG. 11 illustrates a perspective view of a connector housing according to still another embodiment of the present invention.

FIG. 11 illustrates a wire retaining system according to still another embodiment of the present invention, including a connector housing 400 having wire terminal 100 (not shown in FIG. 11) incorporated therein for receiving a wire 105 (not shown in FIG. 11). Connector housing 400 further includes a retention member 1000, which extends from connector housing 400. Retention member 1000 is formed into a "T" shape, wherein arms 1003 extend to form a slot 1005 between arms 1003 and connector housing 400. Arms 1003 further include wire guides 1101, which are configured to permit insertion of wire 105 through the wire guides 1101 and into opening 600. The wire guides 1101 form openings or channels through which the wire may be inserted to permit the guided insertion of wires 105 into openings 600. Retention member 1000 may be formed into connector housing 400 as a unitary piece or may be attached to connector housing 400.

Figure 12:
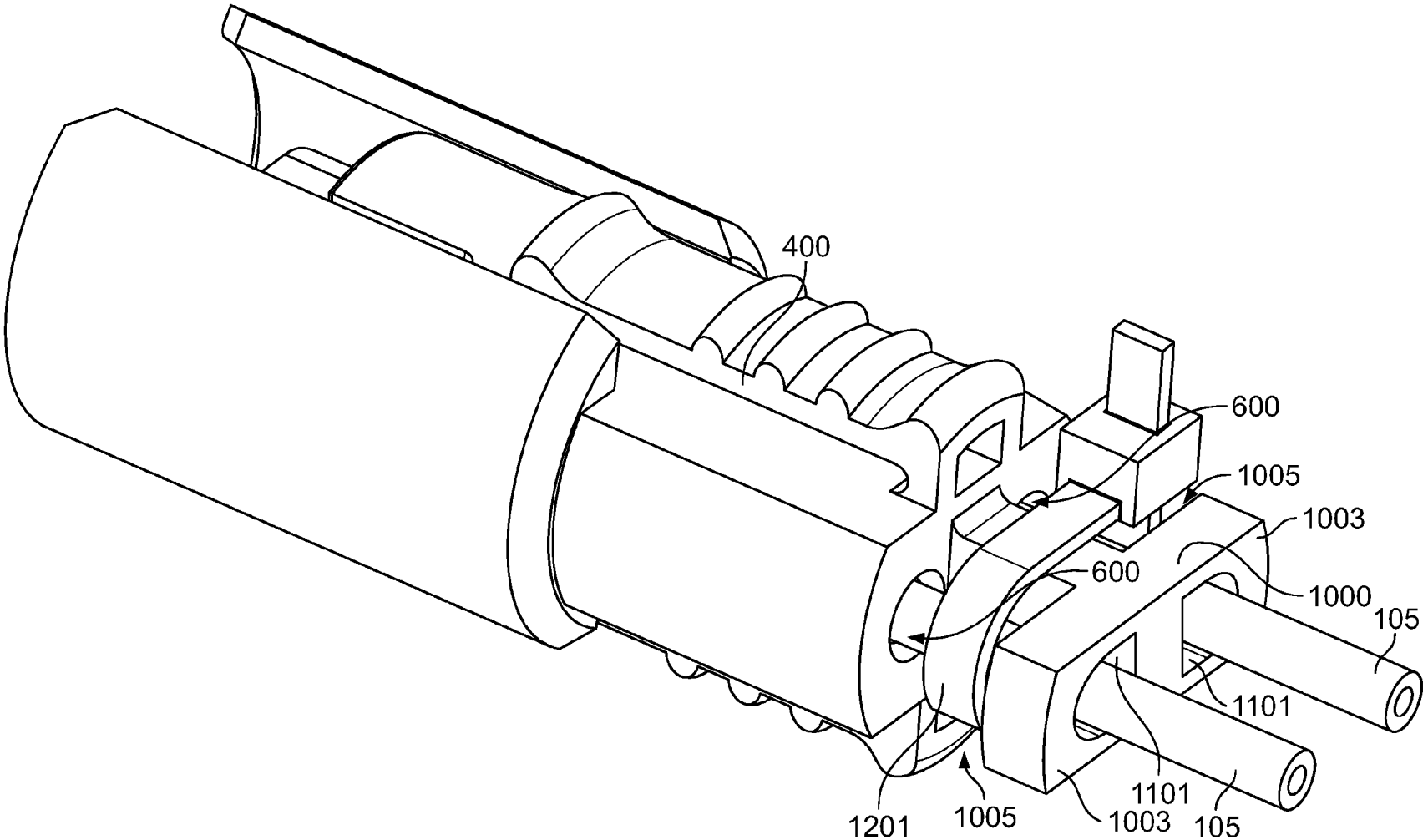
FIG. 12 illustrates a perspective view of a connector housing according to the embodiment of FIG. 11, with wires and cable tie installed, of the present invention.

FIG. 12 includes an embodiment of the present invention including the retention member shown and described with respect to FIG. 11. In addition, FIG. 12 includes wires 105 and a cable tie 1201 arranged in slots 1005 wherein the cable tie 1201 provides at least a partial inwardly directed circumferential force to retain wires 105 in position. Cable tie 1201 is any device capable of providing a force on wires 105 within slot or slots 1005 that provides resistance to both pulling and rotation. In addition to cable ties, adhesive structures, such as tape, labeling or other wire immobilizing device may also be utilized. The inward retaining force provided by cable tie 1201 is preferably sufficient to provide resistance to unintentional disengagement of the wires 105 due to pulling of the wires 105 and/or rotation of the wires 105.

Figure 13:
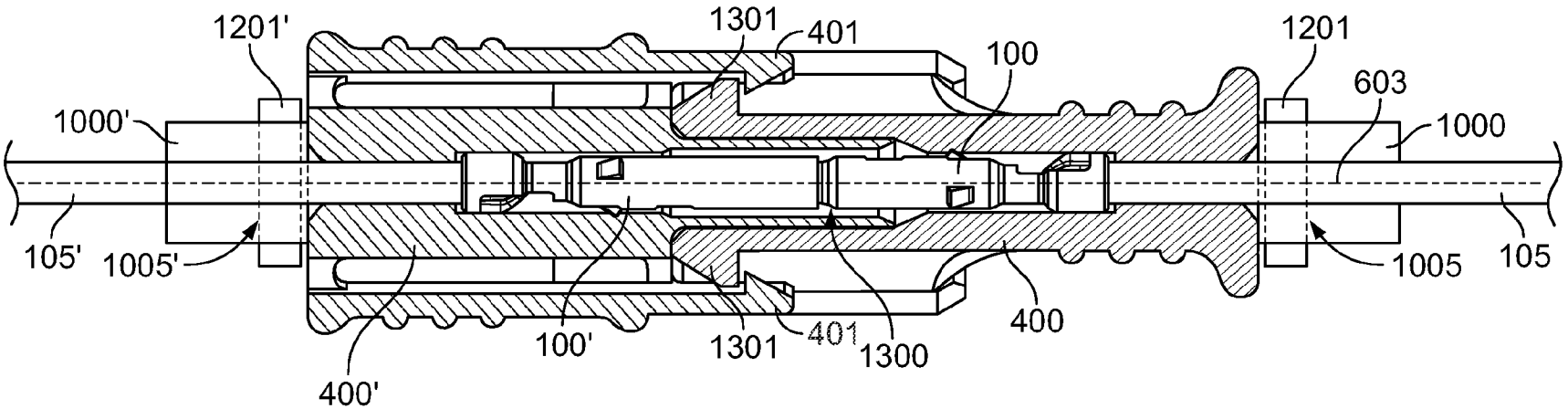
FIG. 13 illustrates an elevational cross-sectional view two-connector housings in an engaged position according to still another embodiment of the present invention.

FIG. 13 illustrates a cross-sectional view of connector housing 400 engaged with a second connector housing 400', wherein the wire 105 and wire terminal 100,100' are shown in elevational cross-sectional view. The connection of connector housings 400 and 400' permits the electrical connection of wire 105 with wire 105' by electrical communication between wire terminal 100 and 100' at junction 1300. Junction 1300 preferably includes coupling of a male plug with a female connection, each corresponding to one of connector housing 400 or connector housing 400'. The engagement of connector housing 400 to connector housing 400' takes place by engagement of disenagable latches 401 of connector housing 400' engaging connector feature 1301 of connector housing 400. The engagement of disengagable latches 401 and connector feature 1301 provides a latched position capable of resisting a retention force between the connector housings 400 and 400'.

In a preferred embodiment, the wire retention of wires 105 is sufficient that forces on wire 105 provide for disengagement of latches 401 and feature 1301 at a lesser force than the force required to disengage wires 105 from connector housing 400.

As further shown in FIG. 13, cable tie 1201 may be positioned in slot 1005, adjacent wire 105. The cable tie 1201 provides force against wire 105 and retention member 1000. The force provided by cable tie 1201 provides resistance to or prevention of unintentional disengagement of wire 105 in response to a pulling force directed along opening center axis 603.

Figure 14:
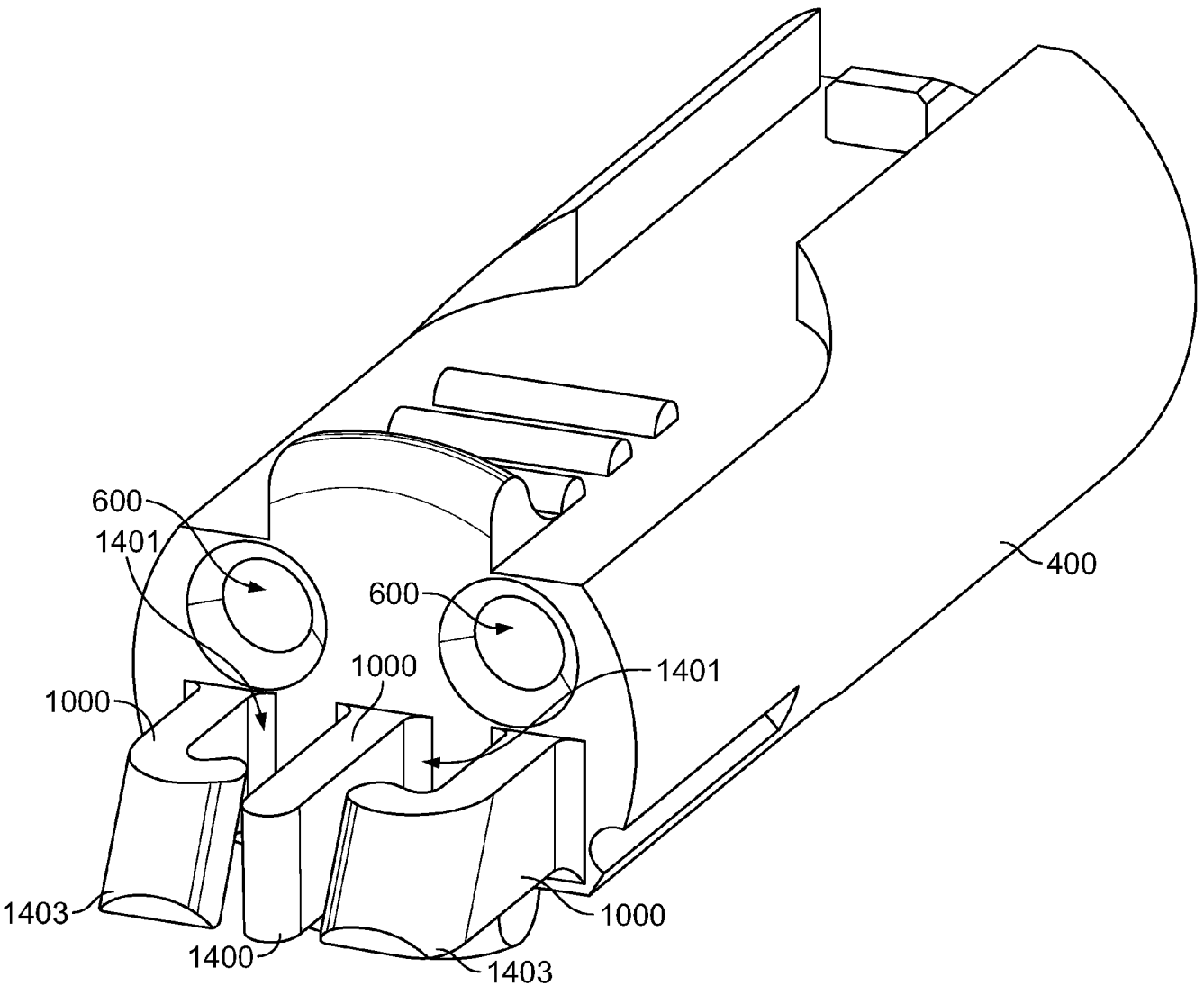
FIG. 14 illustrates a perspective view of a connector housing according to still another embodiment of the present invention.

FIG. 14 illustrates a wire retaining system according to still another embodiment of the present invention, including a connector housing 400 having wire terminal 100 (not shown in FIG. 14) incorporated therein for receiving a wire 105 (not shown in FIG. 14). Connector housing 400 includes opening 600, wherein the opening may extend along a substantially singular axis to wire terminal 100 (see, e.g., FIG. 4), or may include an angle channel 501, such as the structure shown in FIG. 5. Connector housing 400 further includes a retention member 1000, which extends from connector housing 400. Retention member 1000 is formed into a center retention member 1400 and two side retention members 1403 each configured to provide a wire retention guide 1401, which receives the wire 105 and provides a joggle or bend in the wire 105, which provides resistance to pulling and rotation, once the wire 105 is engaged in wire retention guide 1401.

Figure 15:
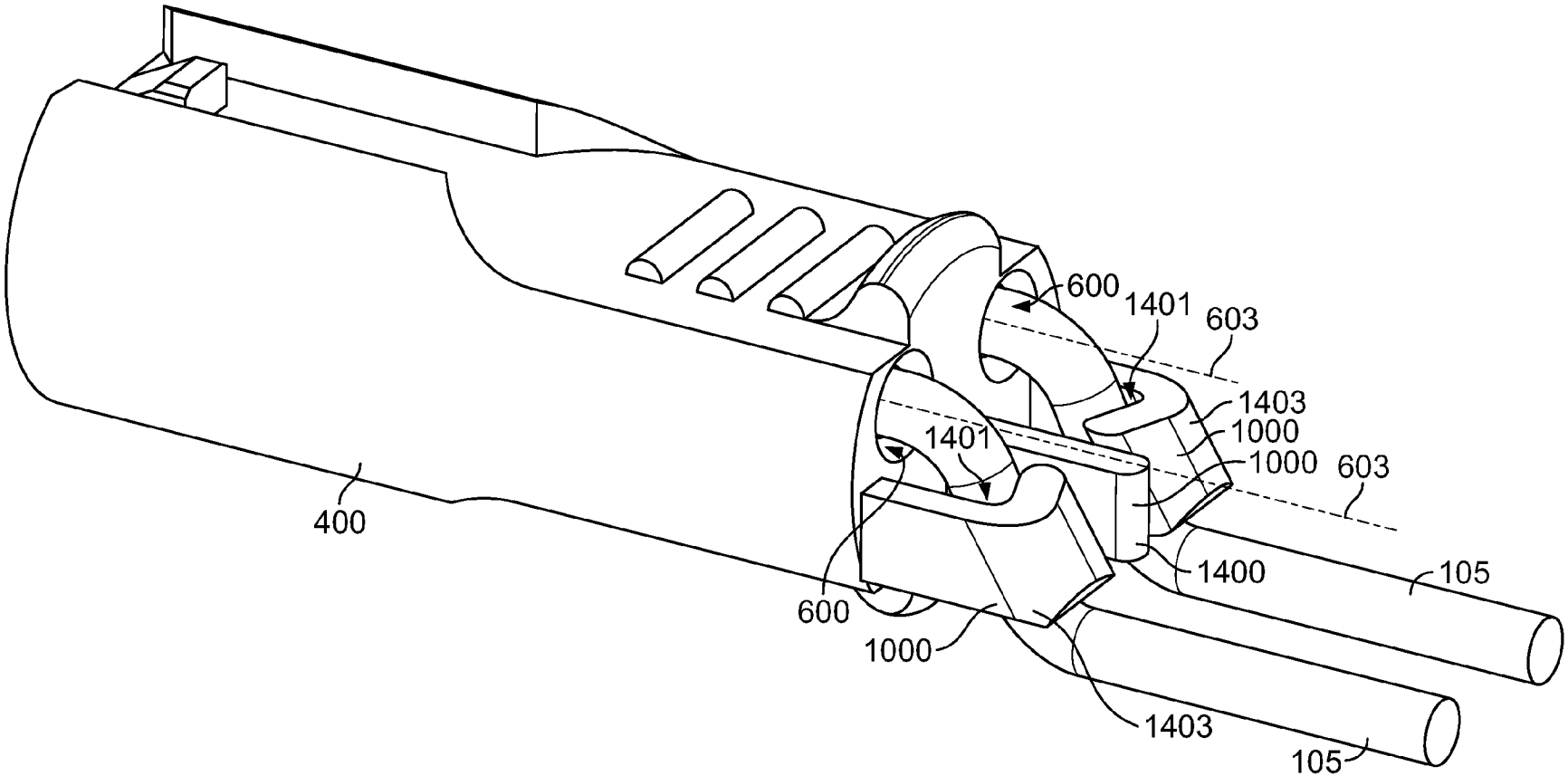
FIG. 15 illustrates a perspective view of a connector housing according to the embodiment of FIG. 14, with wires installed, of the present invention.

FIG. 15 shows the connector housing 400 shown and described with respect to FIG. 14 wherein a wire 105 is installed in each wire retention guide 1401. The wire 105 may be installed by inserting wire 105 along opening center axis 603. The wire 105 is inserted into connector housing 400 until wire 105 is engaged with wire terminal 100 (not shown in FIG. 15). After the wire 105 is fully inserted, the wire 105 protruding from opening 600 is then brought into contact with a surface of wire retention member 1000 between center retention member 1400 and one of the two side retention members 1403. The wire 105 is then guided into wire retention guide 1401. The wire 105 is preferably permitted to snap into the wire retention guide 1401 by elastic deformation of the wire retention member 1000. Snapping, as used herein, indicates a compliant force or elastic resistance that permits the introduction and/or retention of a wire 105 or other structure by virtue of a force that is overcome by application of a greater counter force. In other words, spacing between side retention member 1403 and center retention member 1400 is less than the diameter of wire 105, the elastic resistance between side retention member 1403 and retention member 1400 initially presenting access of wire 105 into wire retention guide 1401. However, upon application of sufficient force applied to wire 105, wire 105 overcomes the retention force between side retention member 1403 and retention member 1400 and decrease wire retention guide 1401. Upon accessing wire retention guide 1401, the wire 105 may then be further oriented or bent to the desired direction of wire installation. The retention member 1000 retains the wire 105 in position with a plurality of bends aligned in a plurality of axes. These bends provide addition resistance to pulling along the opening center axis 603 and resists or prevents undesirable/unintentional disengagement of wire 105 from connector housing 400. Retention member 1000 is configured to provide a wire retention guide 1401, which receives the wire and provides a joggle or narrow bend portion in the wire 105, which provides resistance to pulling and rotation, once the wire 105 is engaged in wire retention guide 1401.

Figure 16:
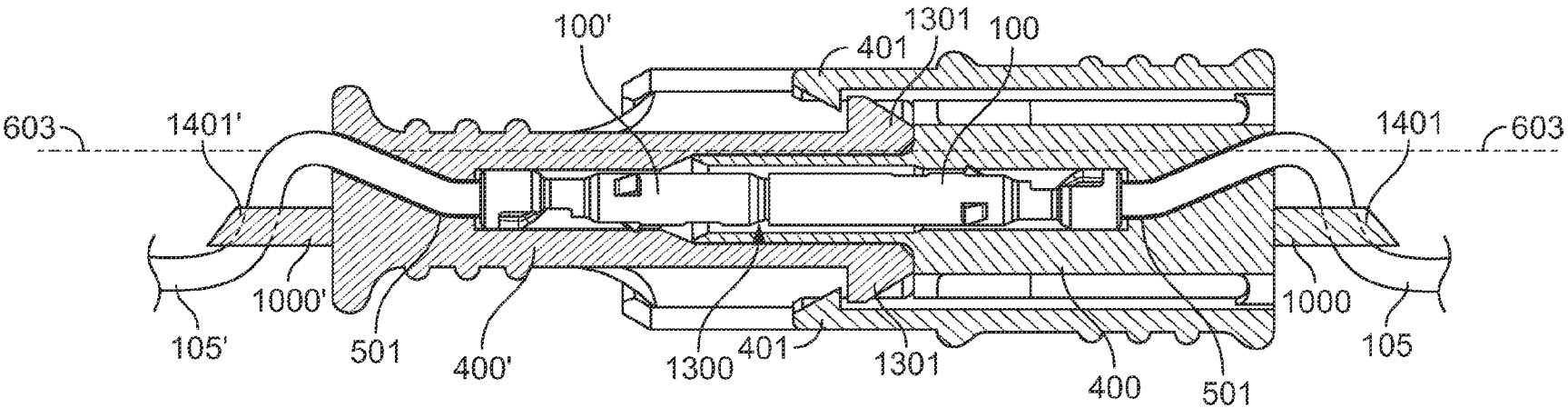
FIG. 16 illustrates an elevational cross-sectional view two-connector housings in an engaged position according to still another embodiment of the present invention.

FIG. 16 illustrates a connector housing 400 engaged with a second connector housing 400'. Connector housing 400 and connector housing 400' are engaged in the manner shown and described above with respect to FIG. 13. As shown, wire 105, 105' is positioned within wire retention guide 1401, 1401' of wire retention member 1000, 1000'. The multiple bends in wire 105, 105' and retention member 1000, 1000' provide resistance to or prevention of unintentional disengagement of wire 105, 105' in response to a pulling force directed along opening center axis 603.

Figure 17:
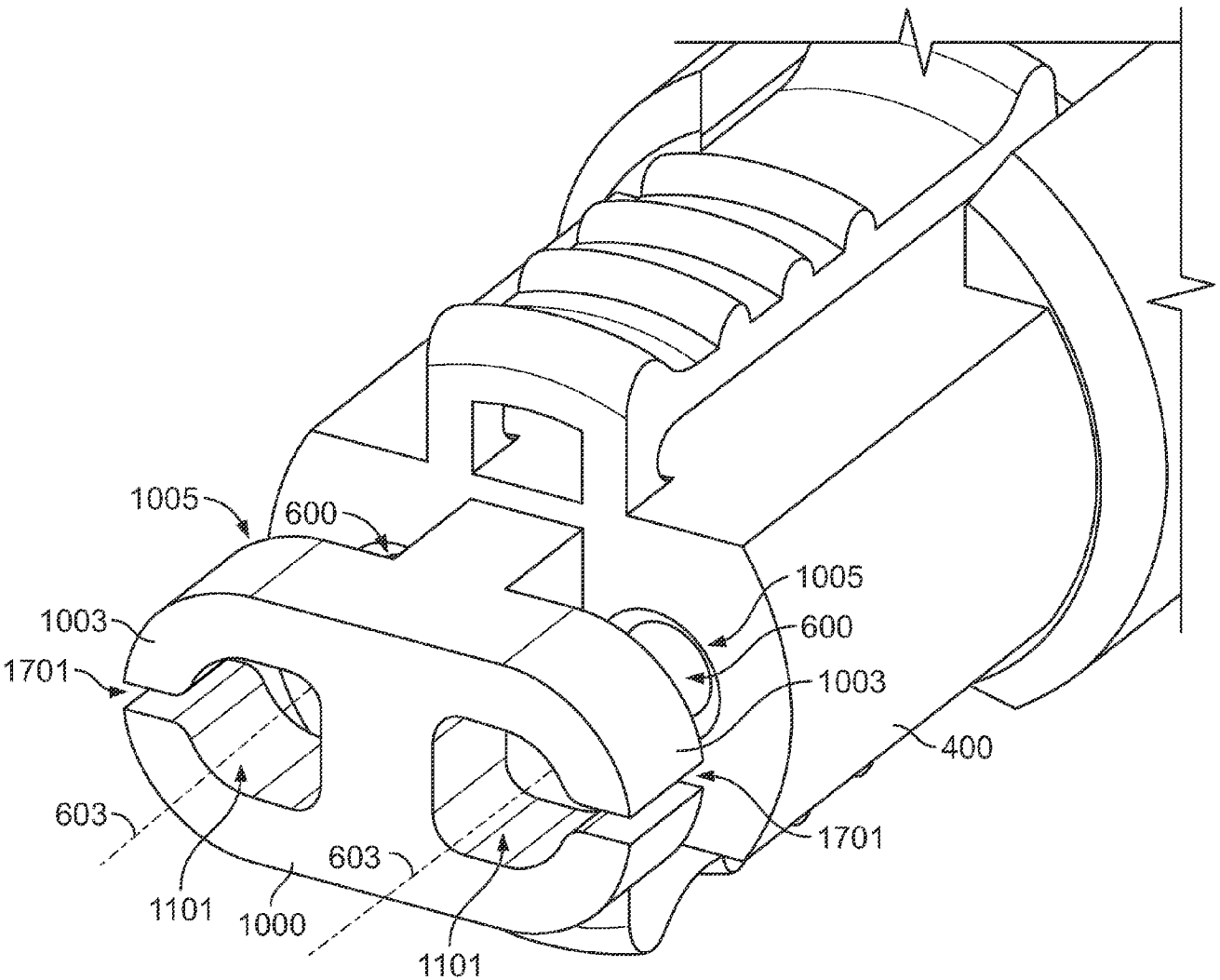
FIG. 17 illustrates an enlarged, partial perspective view of a connector housing according to still another embodiment of the present invention.

FIG. 17 illustrates a wire retaining system according to still another embodiment of the present invention, including a connector housing 400 having wire terminal 100 (not shown in FIG. 17) incorporated therein for receiving a wire 105 (not shown in FIG. 17). Connector housing 400 further includes a retention member 1000, which extends from connector housing 400. Retention member 1000 is formed into a "T" shape, wherein arms 1003 extend to form a slot 1005 between arms 1003 and connector housing 400. Retention member 1000 may be formed into connector housing 400 as a unitary piece or may be attached to connector housing 400. Arms 1003 further include wire guide 1101 and arm slot 1701, which are configured to permit insertion of wire 105 through wire guide 1101 and into opening 600, wherein the wire 105 may further be brought into contact with arm slot 1701 and permitted to snap out of wire guide 1101 by elastic deformation or other mechanism of arm 1003 adjacent to arm slot 1701, such as previously discussed with regard to FIG. 15. The positioning of the wire 105 outside the wire guide 1101 permits wire 105 to be oriented along a plurality of axes (i.e., to have a plurality of bends). These bends provide addition resistance to pulling along the opening center axis 603 and resists or prevents undesirable/unintentional disengagement of wire 105 from connector housing 400 (see, e.g., FIGS. 21 and 22). Thus, removal of wire 105 from wire guide 1101 through arm slot 1701 provides a joggle or bend in the wire 105, which provides resistance to pulling and rotation once the wire is engaged adjacent to retention member 1000.

Figure 18:
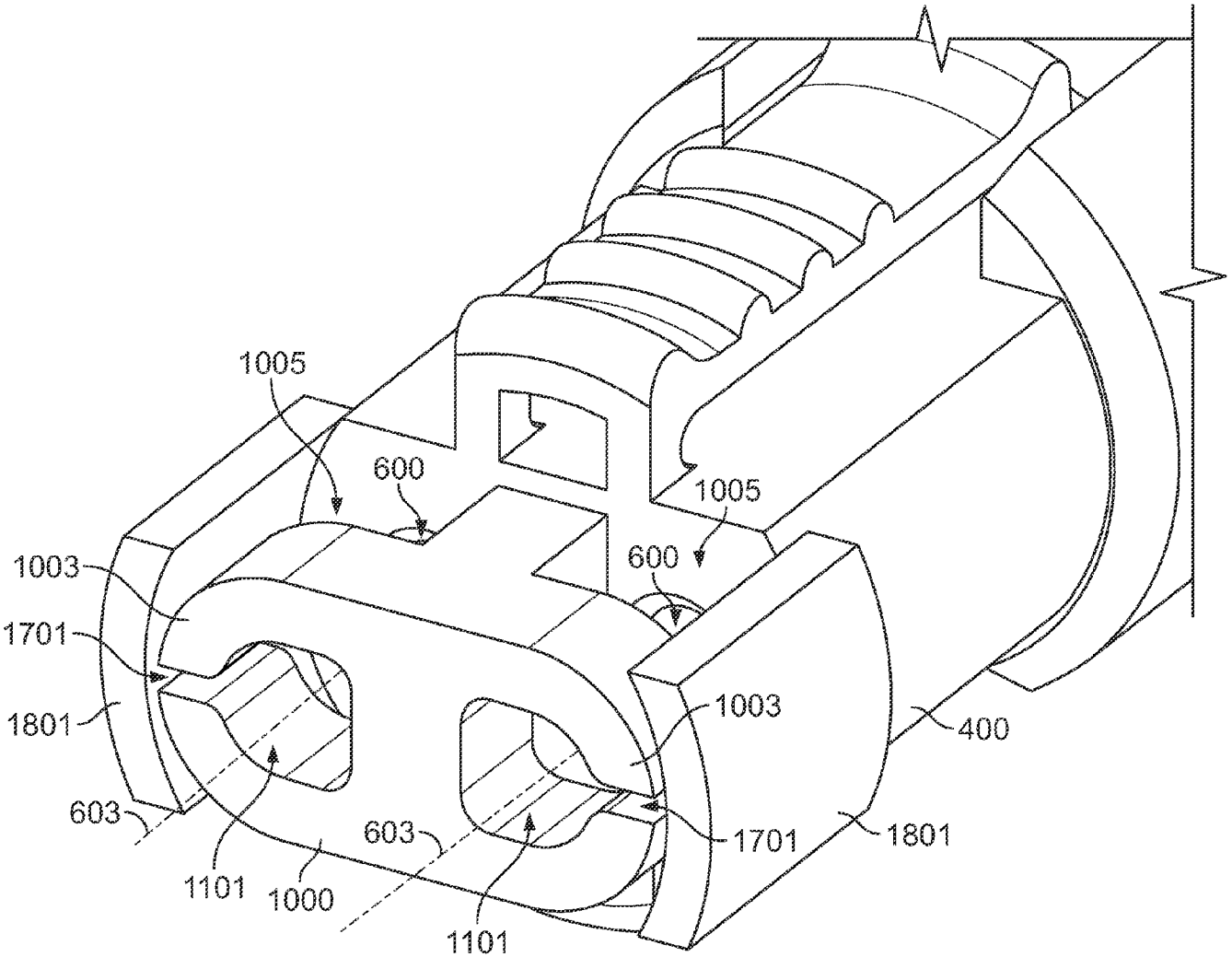
FIG. 18 illustrates an enlarged, partial perspective view of a connector housing according to still another embodiment of the present invention.

FIG. 18 illustrates a wire retaining system according to still another embodiment of the present invention, including a connector housing 400 having wire terminal 100 (not shown in FIG. 18) incorporated therein for receiving a wire 105 (not shown in FIG. 18). FIG. 18 includes substantially the same arrangement of connector housing 400, openings 600, wire retention member 1000, arm 1003, wire guide 1101, and arm slot 1701, as shown and described with respect to FIG. 17. However, the embodiment shown in FIG. 18 further includes side guards 1801 configured to permit the passage of wire 105 out of wire guide 1101, but substantially prevents the reinsertion of wire 105 into wire guide 1101. In addition, the structure of FIG. 18 provides addition wire dress and/or wire management in connector systems and the storage/transportation of connector systems.

Figure 19:
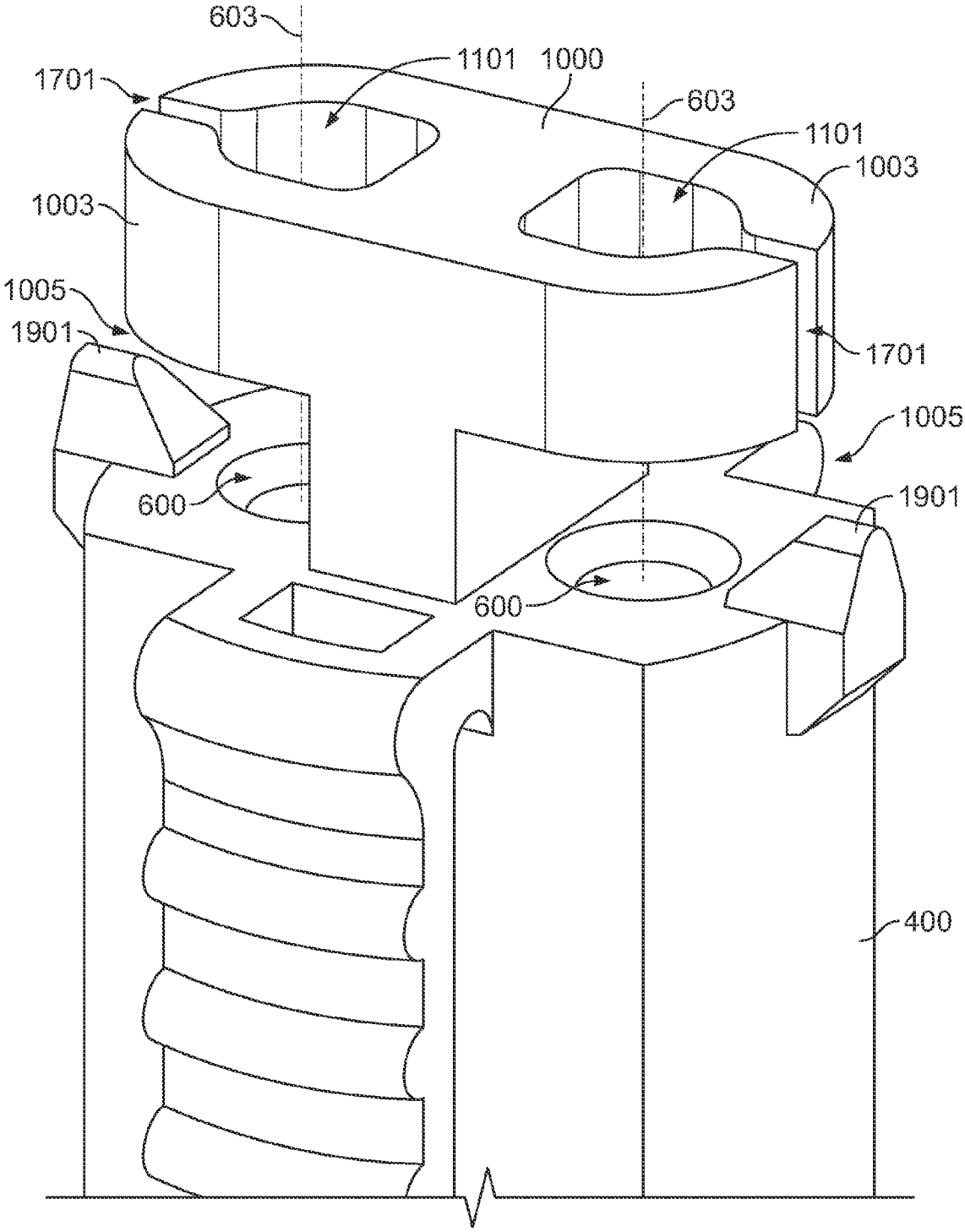
FIG. 19 illustrates an enlarged, partial perspective view of a connector housing according to still another embodiment of the present invention.

FIG. 19 illustrates a wire retaining system according to still another embodiment of the present invention, including a connector housing 400 having wire terminal 100 (not shown in FIG. 19) incorporated therein for receiving a wire 105 (not shown in FIG. 19). FIG. 19 includes substantially the same arrangement of connector housing 400, openings 600, wire retention member 1000, arm 1003, wire guide 1101, and arm slot 1701, as shown and described with respect to FIG. 17. However, the embodiment shown in FIG. 19 further includes guard features 1901 configured to permit the passage of wire 105 out of wire guide 1101, but substantially prevents the reinsertion of wire 105 into wire guide 1101. In addition, the guard features 1901 act to limit rotation of the wire disposed within the slot 1005. Specifically, the guard features preferably provide guidance for the wire to a position away from arm slot 1701 and substantially confines movement of wire 105 to either side of guard feature 1901.

Figure 20:
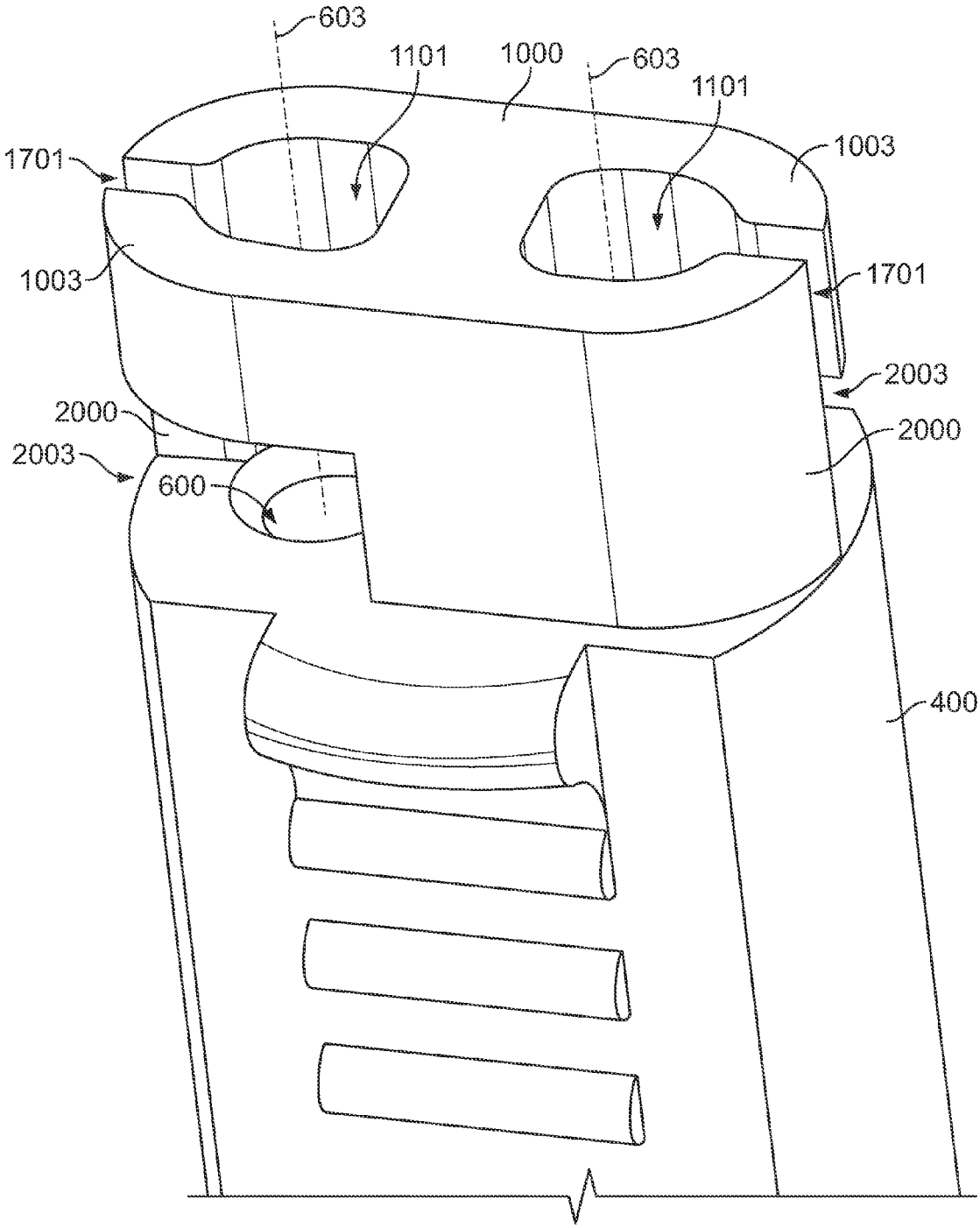
FIG. 20 illustrates an enlarged, partial perspective view of a connector housing according to still another embodiment of the present invention.

FIG. 20 illustrates a wire retaining system according to still another embodiment of the present invention, including a connector housing 400 having wire terminal 100 (not shown in FIG. 20) incorporated therein for receiving a wire 105 (not shown in FIG. 20). FIG. 20 includes substantially the same arrangement of connector housing 400, openings 600, wire guide 1101, and arm slot 1701, as shown and described with respect to FIG. 17. However, the wire retention member 1000 includes sidewalls 2000 extending from arms 1003 to the connector housing 400. The sidewalls 2000 and wire retention member 1000 are configured to provide a side opening 2003 for receiving and retaining wire 105 (see FIG. 21). The configuration of FIG. 20 provides improved strength of the wire retention member 1000 by formation of sidewalls 2000, which resists breakage. In addition, the formation of sidewalls 2000 reduces or eliminates surfaces susceptible to snagging, particularly during storage and/or transportation, wherein a plurality of wire connector systems and their associated wires 105 may be present. In addition, the reentry of the wire into slot 1701 is made difficult because the formation of sidewall 2000 provides a surface against which little or no deflection may take place. In other words, in order for wire 105 to reenter wire guide, the arm 1003 must deflect a distance substantially equal to the diameter of wire 105, which requires a greater force than deflection of two opposing arms 1003, as shown, for example, in FIG. 17.

Figure 21:
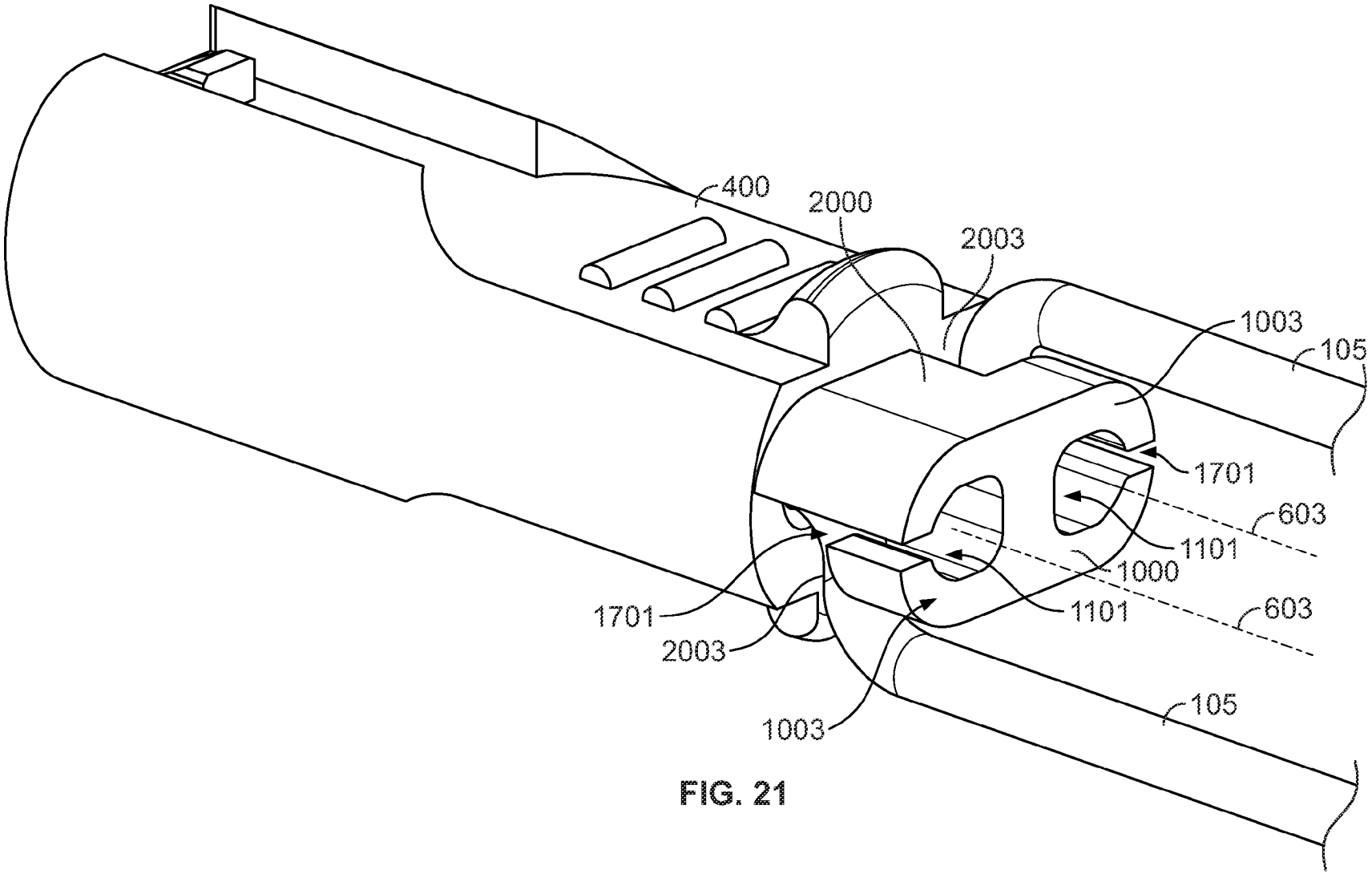
FIG. 21 illustrates an enlarged, partial perspective view of a connector housing according to the embodiment of FIG. 20, with wires installed.

FIG. 21 shows the connector housing 400 shown and described with respect to FIG. 20 wherein a wire 105 is installed. The wire 105 is installed by inserting wire 105 along opening center axis 603. The wire 105 is inserted into connector housing 400 until wire 105 is engaged with wire terminal 100 (not shown in FIG. 21). After the wire 105 is fully inserted, the wire 105 extending past the end of connector housing 400 is then brought into contact with a surface of slot 1701. The wire 105 is then guided into side opening 2003. The wire 105 is preferably permitted to snap outside of wire guide 1101 into side opening 2003 by elastic deformation of the wire retention member 1000 as previously discussed with regard to FIG. 15. The wire 105 may then be further oriented or bent to the desired direction of wire installation. The wire retention member 1000 retains the wire 105 in position with a plurality of bends oriented in a plurality of axes. These bends provide addition resistance to pulling along the opening center axis 603 and resists or prevents undesirable disengagement of wire 105 from connector housing 400. Retention member 1000 is configured to provide a side opening 2003, which receives the wire 105 and provides a joggle or bend in the wire 105, which provides resistance to pulling and rotation, once the wire 105 is engaged in side opening 2003.

Figure 22:
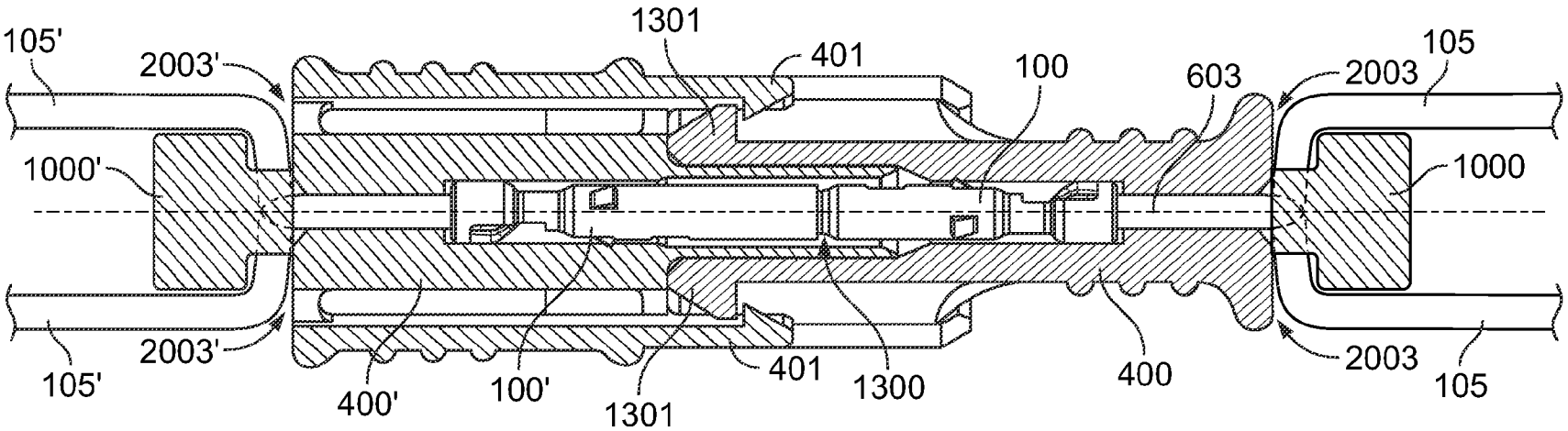
FIG. 22 illustrates an elevational cross-sectional view two-connector housings in an engaged position according to still another embodiment of the present invention.

FIG. 22 illustrates a connector housing 400 engaged with a second connector housing 400'. Connector housing 400 and connector housing 400' are engaged in the manner shown and described above with respect to FIG. 13. As shown, wire 105, 105' is positioned within side opening 2003, 2003' of wire retention member 1000, 1000'. The multiple bends in wire 105, 105' adjacent to retention member 1000, 1000' provide resistance to or prevention of unintentional disengagement of wire 105, 105' in response to a pulling force directed along opening center axis 603.

Figure 23:
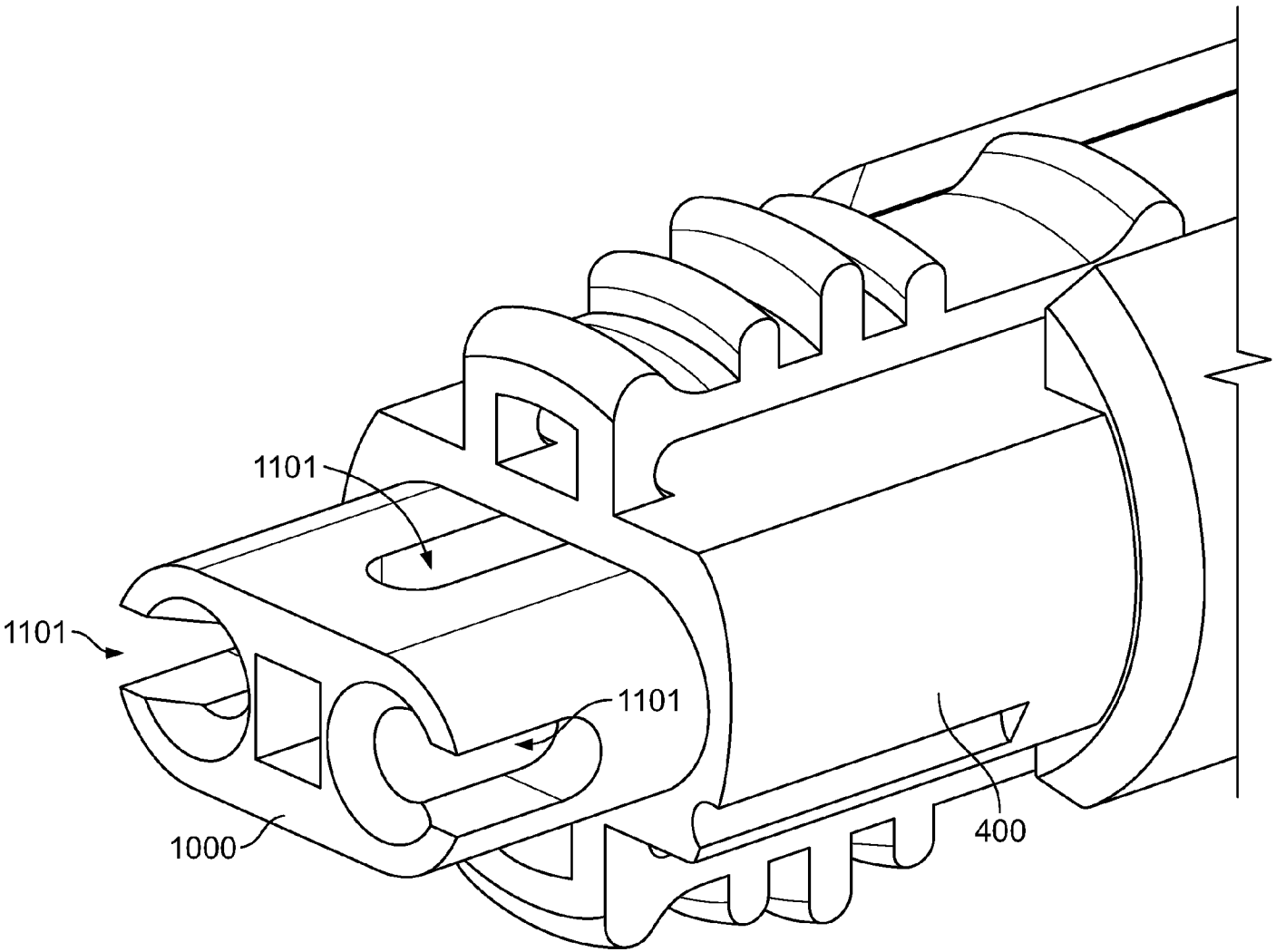
FIG. 23 illustrates an enlarged, partial perspective view of a connector housing according to still another embodiment of the present invention.
Figure 24:
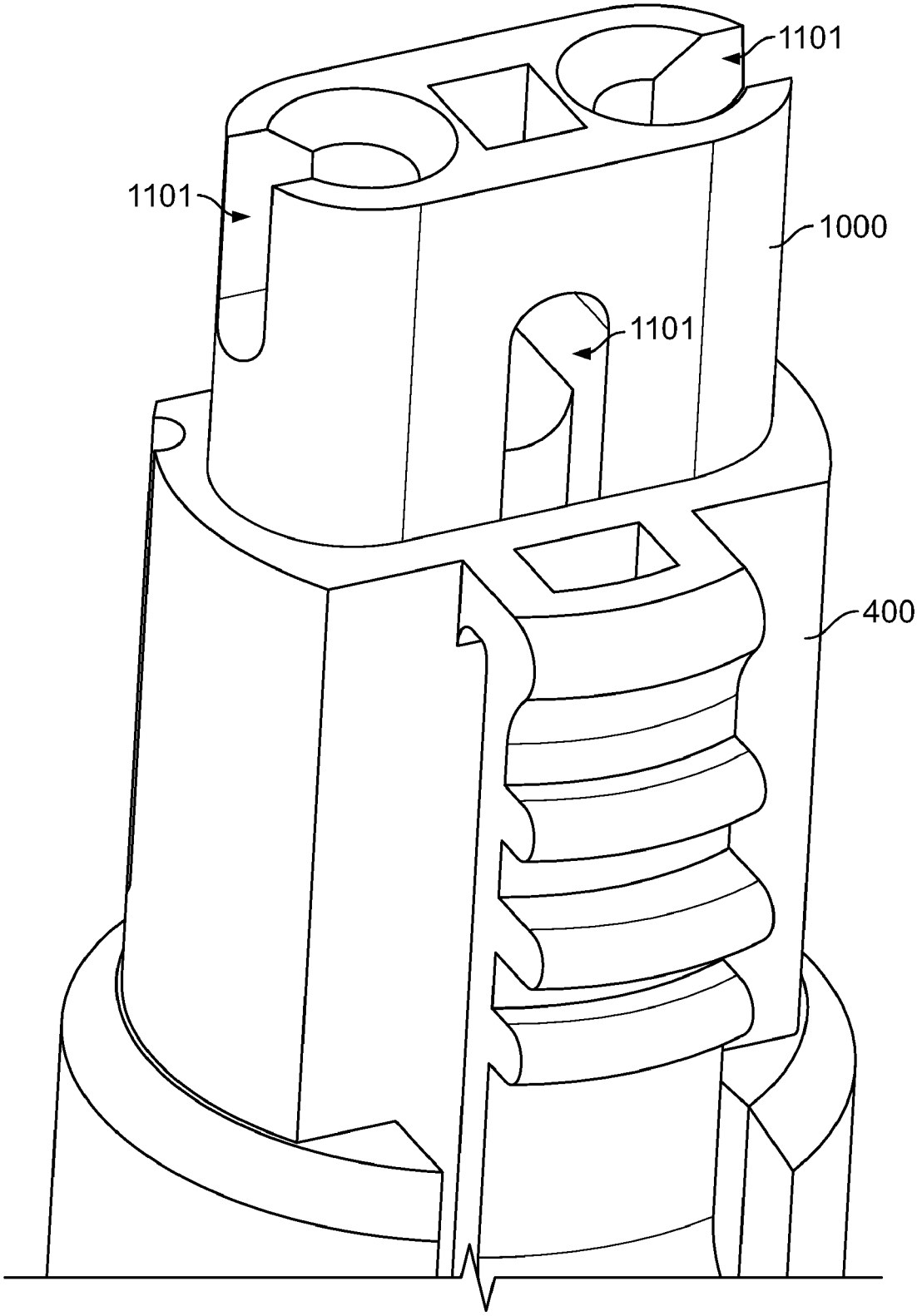
FIG. 24 illustrates an alternate perspective view of the connector of FIG. 23.

FIGS. 23 and 24 illustrate a wire retaining system according to still another embodiment of the present invention, including a connector housing 400 having wire terminal 100 (not shown in FIG. 23 or 24) incorporated therein for receiving a wire 105 (not shown in FIG. 23 or 24). Connector housing 400 further includes a retention member 1000, which extends from connector housing 400. Retention member 1000 includes a plurality of wire guides 1101, arranged as passages and/or openings in retention member 1000 configured to receive wire 105 in a manner that allows threading the wire 105 through passages to form multiple loops, bends and/or joggles, wherein the wires 105 are aligned along a plurality of axes.

Figure 25:
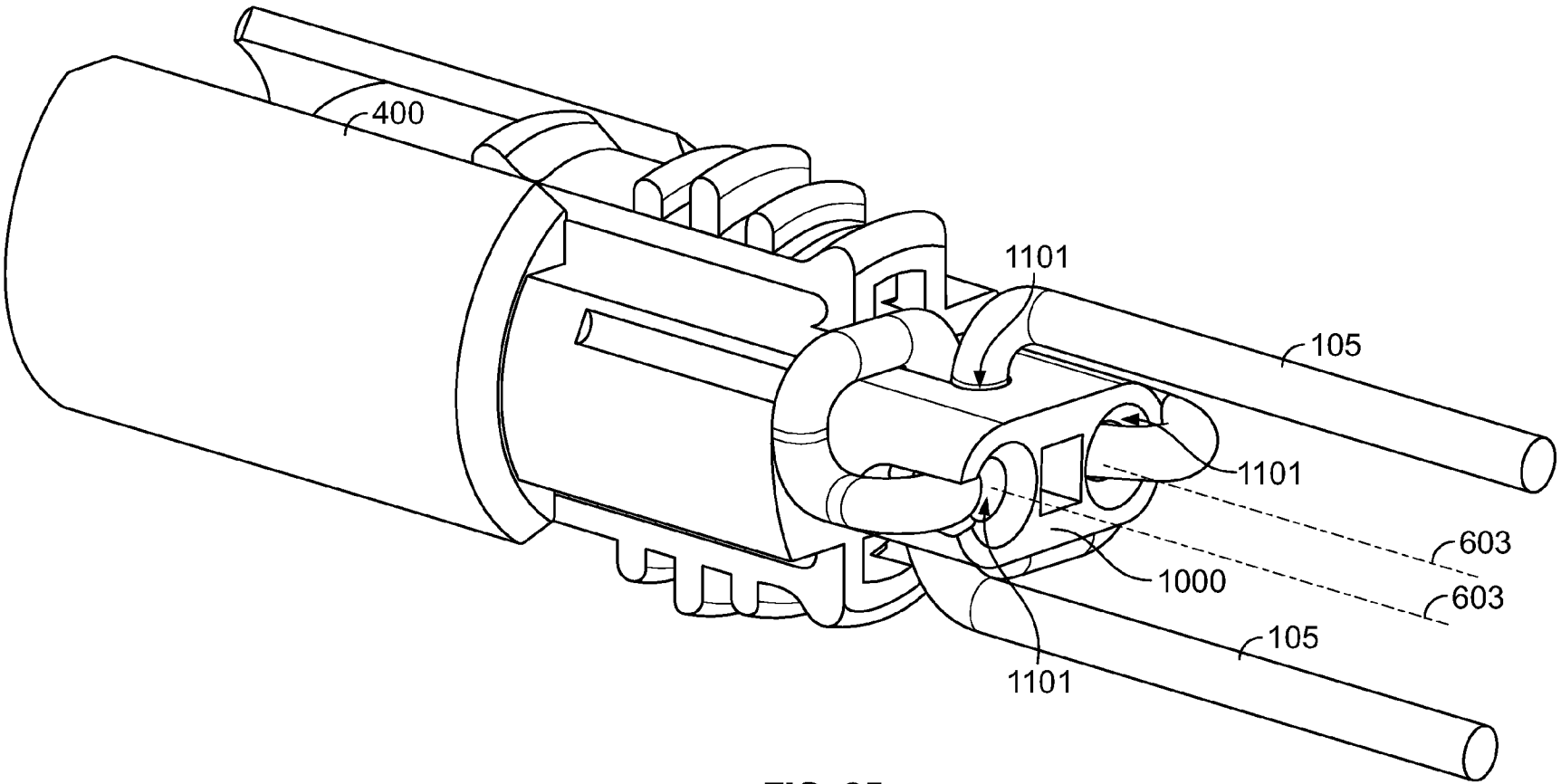
FIG. 25 illustrates a perspective view of a connector housing according to the embodiment of FIGS. 23 and 24, with wires installed.

FIG. 25 shows the connector housing 400 shown and described with respect to FIGS. 23 and 24, wherein a wire 105 is installed. The wire 105 is installed by inserting wire 105 along opening center axis 603. The wire 105 is inserted into connector housing 400 until wire 105 is engaged with wire terminal 100 (not shown in FIG. 25). After the wire 105 is fully inserted, the wire 105 is then bent at an angle substantially perpendicular to the opening center axis 603 and positioned within wire guide 1101. The wire 105 is then threaded through wire guide 1101 located substantially at the center of wire retention member 1000, wherein the wire 105 is passed through the retention member 1000 and again bent in the desired direction of use. The wire retention member 1000 retains the wire 105 in position with a plurality of bends aligned in a plurality of axes. These bends provide addition resistance to pulling along the opening center axis 603 and resists or prevents undesirable disengagement of wire 105 from connector housing 400. Retention member 1000 is configured to provide a pluarality of wire guides 1101, which receives the wire 105 and provides a joggle or bend in the wire 105, which provides resistance to pulling and rotation, once the wire 105 is engaged in wire guides 1101.

Figure 26:
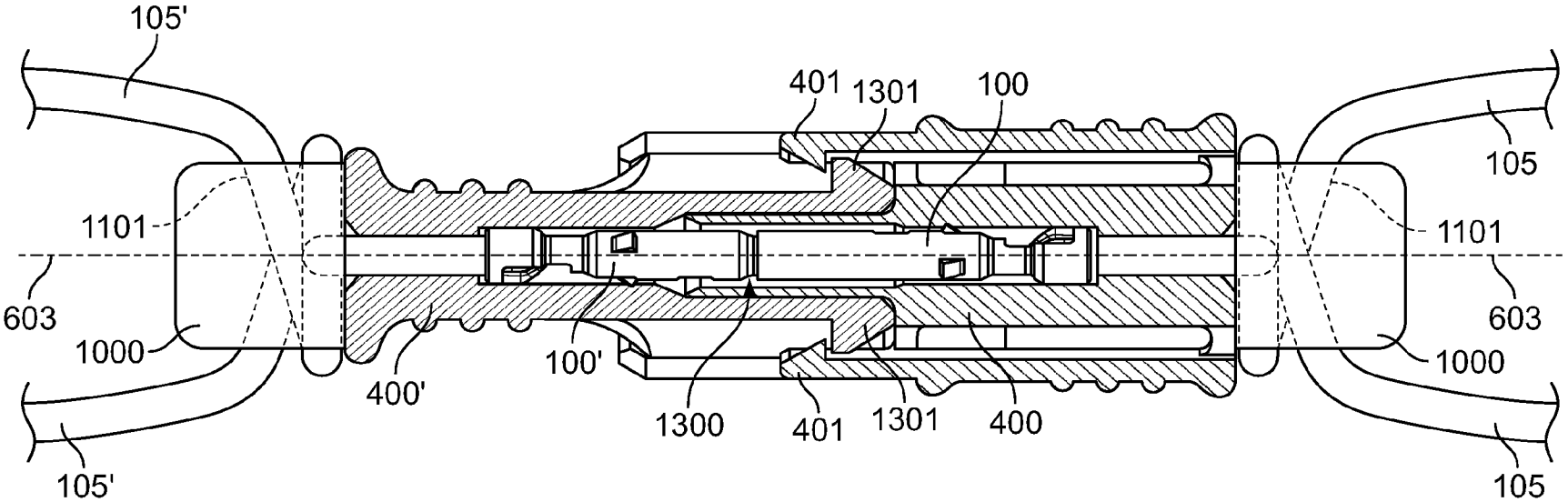
FIG. 26 illustrates an elevational cross-sectional view two-connector housings in an engaged position according to still another embodiment of the present invention.

FIG. 26 illustrates a connector housing 400 engaged with a second connector housing 401' showing the positioning of wires 105, 105', as described above with respect to FIG. 25. Connector housing 400 and connector housing 400' are engaged in the manner shown and described above with respect to FIG. 13. As shown, wire 105, 105' is positioned within wire guides 1101, 1101' of wire retention member 1000, 1000'. The multiple bends in wire 105, 105' and retention member 1000, 1000' provide resistance to or prevention of unintentional disengagement of wire 105, 105' in response to a pulling force directed along opening center axis 603.

Figure 27:
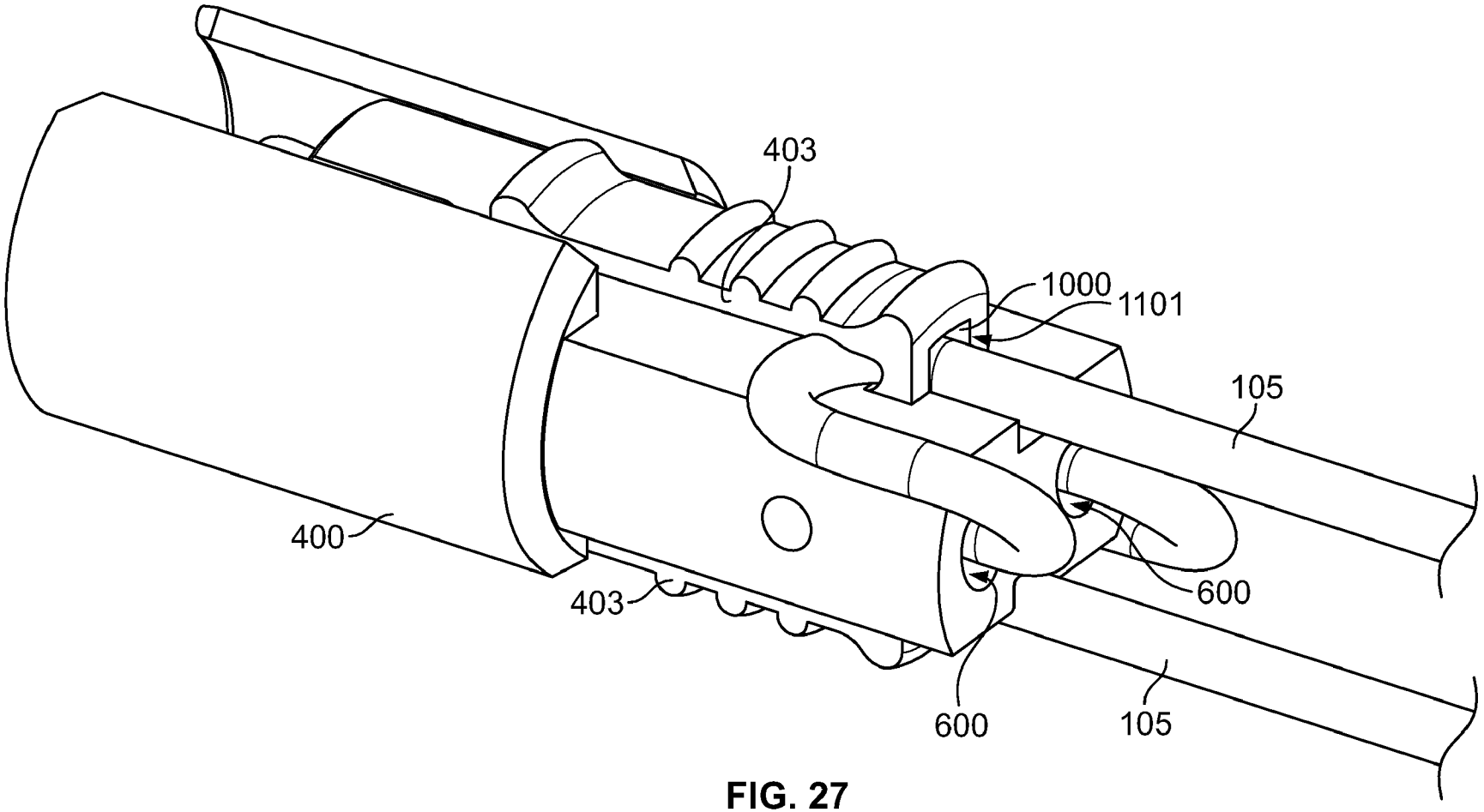
FIG. 27 illustrates a perspective view of a connector housing with wires installed, according to still another embodiment of the present invention.

FIG. 27 illustrates a wire retaining system according to still another embodiment of the present invention, including a connector housing 400 having wire terminal 100 (not shown in FIG. 27) incorporated therein for receiving a wire 105 (not shown in FIG. 27). Connector housing 400 includes a wire retention member 1000 and a wire guide 1101 incorporated into the connector housing 400. As shown in FIG. 27, wire 105 is inserted into opening 600 and threaded through wire retention member 1000 and wire guide 1101. As shown, wire retention member 1000 and wire guide 1101 are bound in latch arms 403. The threading of the wire 105 results in a bend or joggle in the wire 105 that provides alignment along a plurality of axes, which provides resistance to pulling and rotation, once the wire 105 is engaged and threaded through wire retention member 1000 and wire guide 1101.

Figure 28:
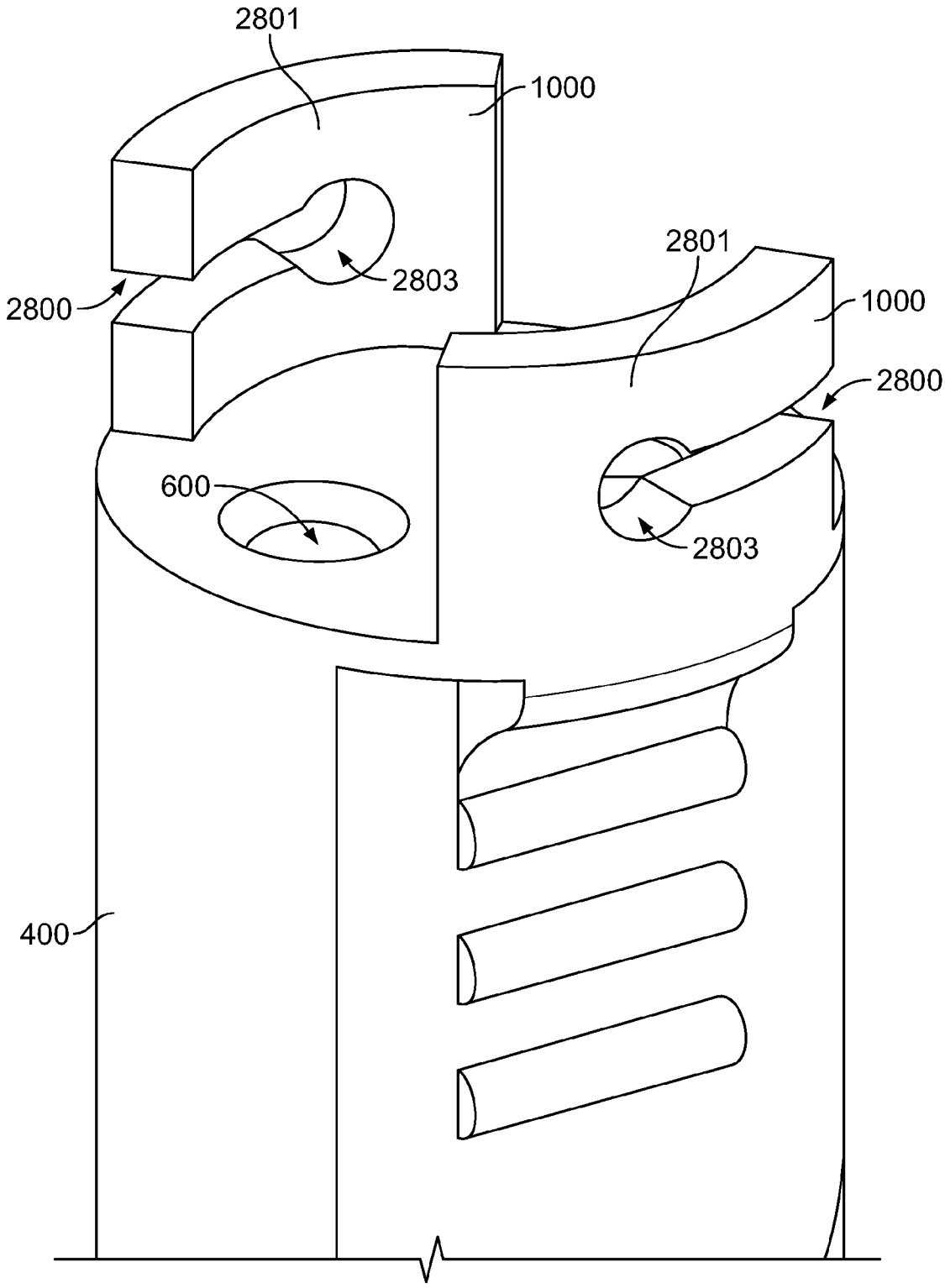
FIG. 28 illustrates a perspective view of a connector housing according to still another embodiment of the invention.

FIG. 28 illustrates a wire retaining system according to still another embodiment of the present invention, including a connector housing 400 having wire terminal 100 (not shown in FIG. 28) incorporated therein for receiving a wire 105 (not shown in FIG. 28). FIG. 28 includes substantially the same arrangement of connector housing 400 and openings 600, as shown and described with respect to FIG. 17. However, the embodiment shown in FIG. 28 further includes a wire retention member 1000 that is configured with two insertion arms 2801 having an insertion slot 2800 and an insertion opening 2803. While the embodiment shown in FIGS. 28-30 show two insertion arms 2801, any number of insertion arms 2801 may be utilized.

Figure 29:
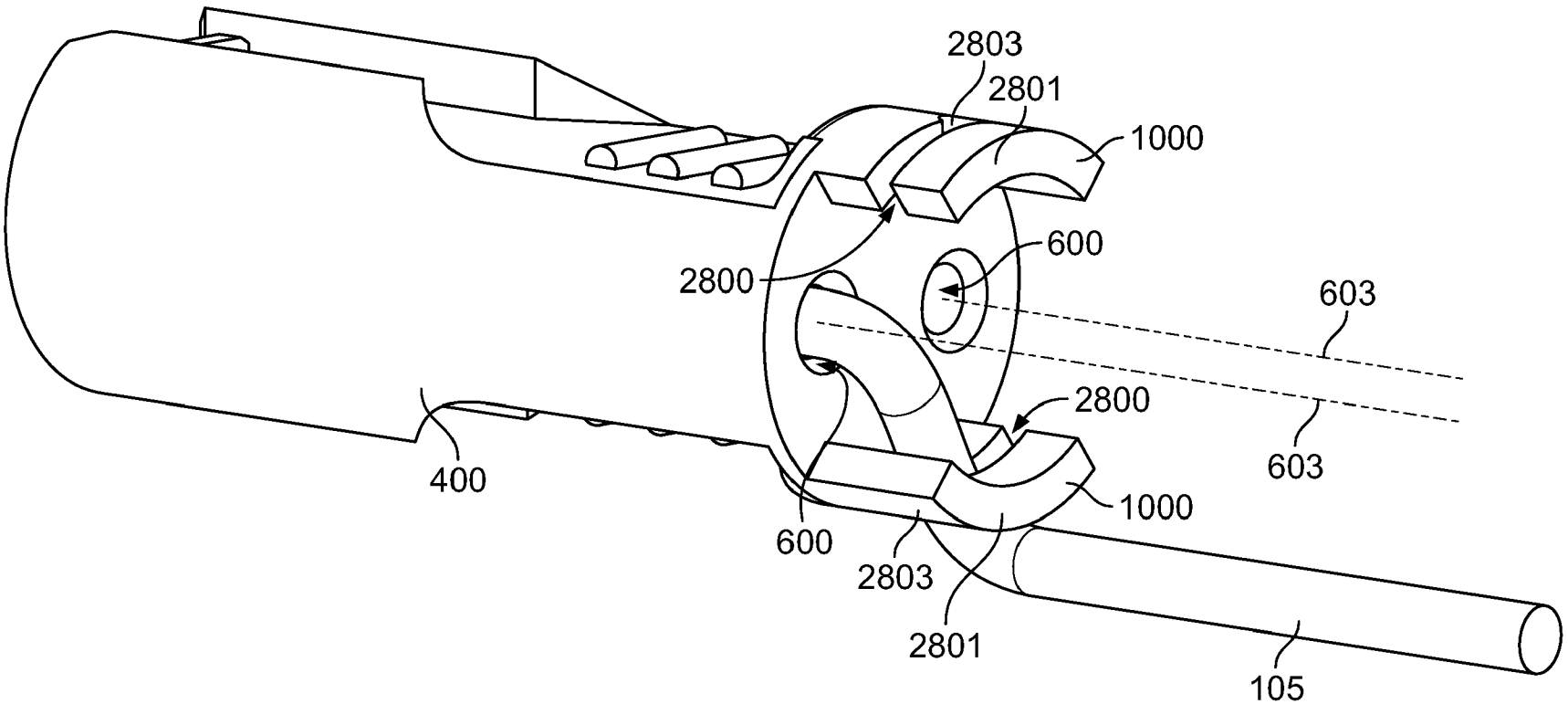
FIG. 29 illustrates a perspective view of a connector housing with one wire installed, according to the embodiment of FIG. 28.

FIG. 29 shows the connector housing 400 shown and described with respect to FIG. 28, wherein a wire 105 is installed. The wire 105 is installed by inserting wire 105 along opening center axis 603. The wire 105 is inserted into connector housing 400 until wire 105 is engaged with wire terminal 100 (not shown in FIG. 29). After the wire 105 is fully inserted, the wire 105 extending from opening 600 is then bent at an angle substantially perpendicular to opening center axis 603. The wire 105 is then guided into insertion slot 2800 of insertion arm 2801 and along insertion slot 2800 until the wire 105 is positioned in insertion opening 2803. The wire 105 is preferably permitted to snap into insertion opening 2803 by elastic deformation of the insertion arm 2801 as previously discussed with regard to FIG. 15. The wire 105 may then be further bent or oriented to the desired direction of wire 105 installation. The wire retention member 1000 retains the wire 105 in position with a plurality of bends aligned in a plurality of axes. These bends provide addition resistance to pulling along the opening center axis 603 and resists or prevents undesirable disengagement of wire 105 from connector housing 400. Retention member 1000 is configured to provide insertion opening 2803, which receives the wire 105 and provides a joggle or bend in the wire 105, which provides resistance to pulling and rotation, once the wire 105 is engaged in insertion opening 2803.

Figure 30:
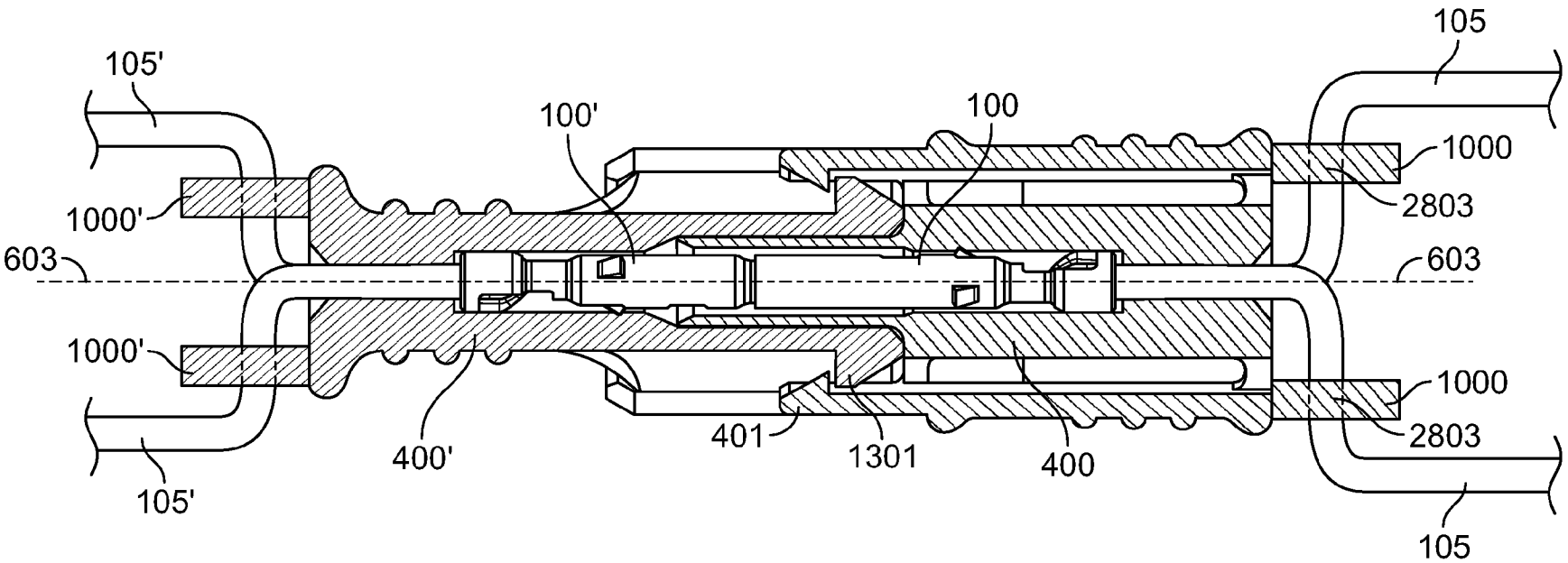
FIG. 30 illustrates an elevational cross-sectional view two-connector housings in an engaged position according to still another embodiment of the present invention.

FIG. 30 illustrates a connector housing 400 engaged with a second connector housing 400'. Connector housing 400 and connector housing 400' are engaged in the manner shown and described above with respect to FIG. 13. As shown, wire 105 is positioned within insertion opening 2803, 2803' of wire retention member 1000, 1000'. The multiple bends in wire 105, 105' and retention member 1000, 1000' provide resistance to or prevention of undesirable/unintentional disengagement of wire 105, 105' in response to a pulling force directed along opening center axis 603.

Figure 31:
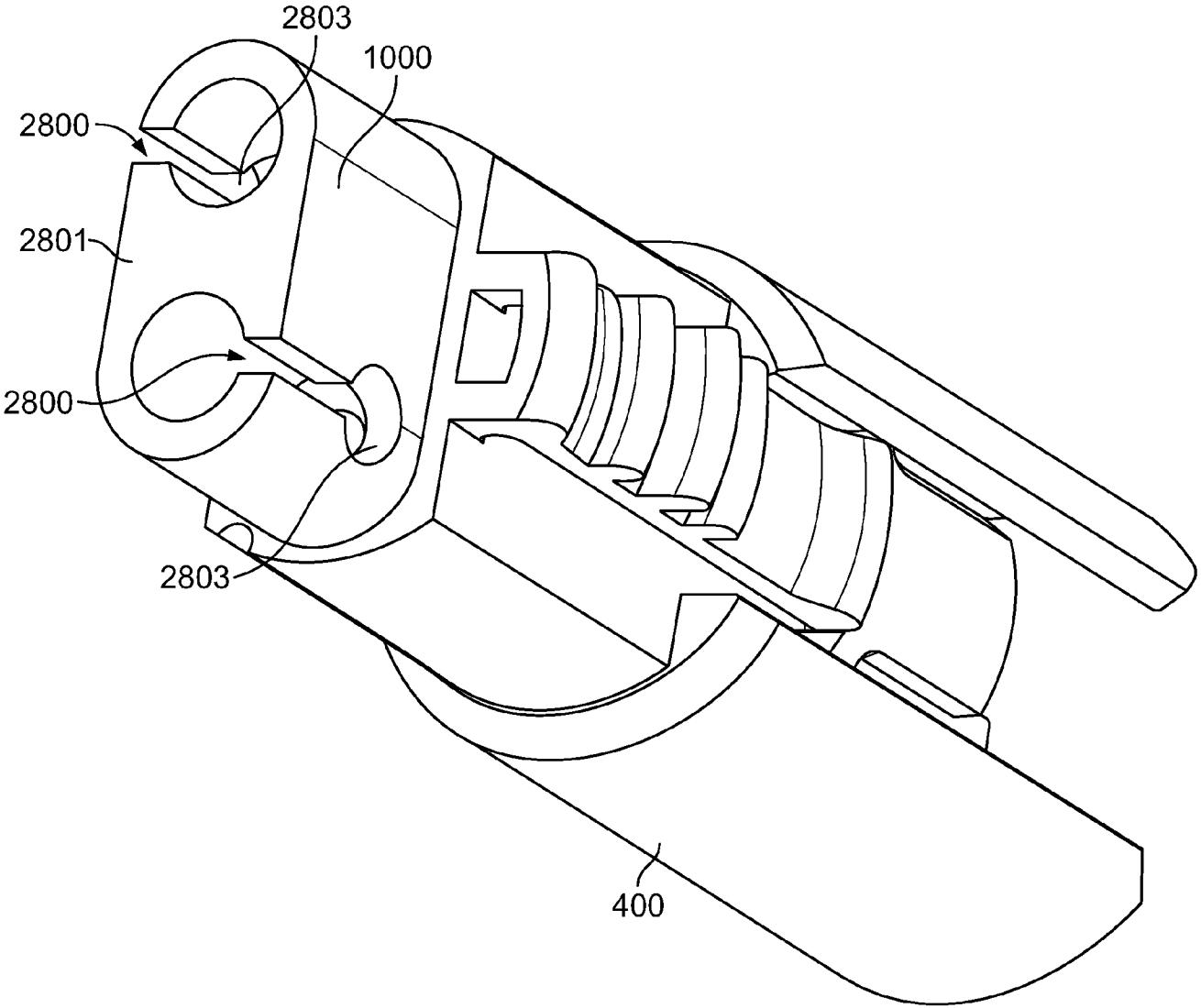
FIG. 31 illustrates a top perspective view of a connector housing according to still another embodiment of the present invention.

FIG. 31 illustrates a wire retaining system according to still another embodiment of the present invention, including a connector housing 400 having wire terminal 100 (not shown in FIG. 31) incorporated therein for receiving a wire 105 (not shown in FIG. 31). FIG. 31 includes substantially the same arrangement of connector housing 400, openings 600, wire retention members 1000, insertion arms 2801 as shown and described with respect to FIGS. 28-30. However, the embodiment shown in FIG. 31 includes a wire retention member 1000 that is configured with one insertion arm 2801. Insertion arm 2801 includes an insertion slot 2800 and an insertion opening 2803 configured to receive each wire 105 of a plurality of wires 105.

Figure 32:
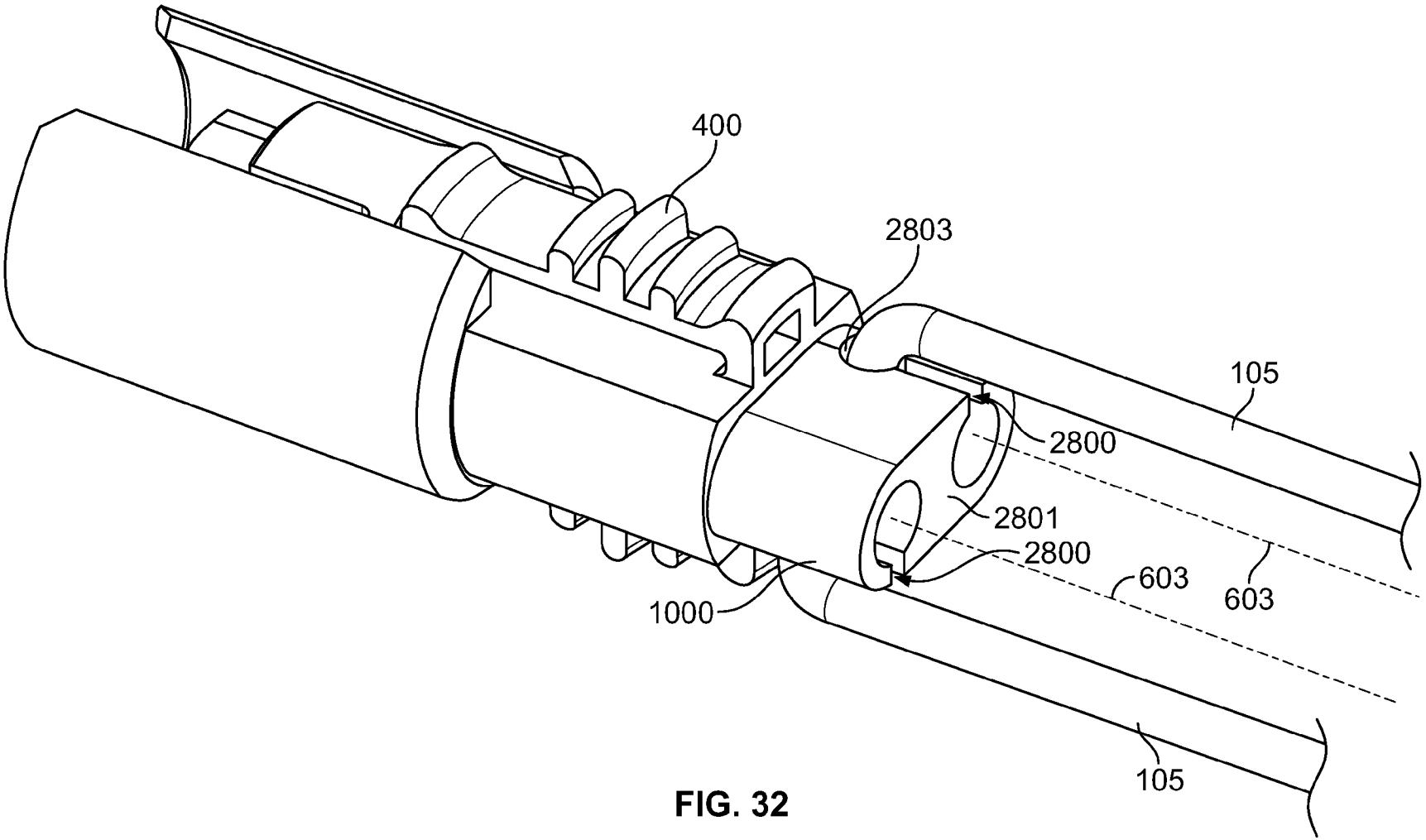
FIG. 32 illustrates a perspective view of a connector housing with wires installed, according to the embodiment of FIG. 31.

FIG. 32 shows the connector housing 400 shown and described with respect to FIG. 31, wherein two wires 105 installed into insertion arm 2801. The wire 105 is installed by inserting wire 105 along opening center axis 603. The wire 105 is inserted into connector housing 400 until wire 105 is engaged with wire terminal 100 (not shown in FIG. 32). After the wire 105 is fully inserted, the wire 105 extending from connector housing 400 is then bent at an angle substantially perpendicular to opening center axis 603 guiding wire 105 into insertion slot 2800 of insertion arm 2801 and along insertion slot 2800 until the wire 105 is positioned in insertion opening 2803. The wire 105 is preferably permitted to snap into insertion opening 2803 by elastic deformation of the insertion arm 2801 as previously discussed with respect to FIG. 15. The wire 105 may then be further bent or oriented to the desired direction of wire 105 installation. The wire retention member 1000 retains the wire 105 in position with a plurality of bends aligned in a plurality of axes. These bends provide addition resistance to pulling along the opening center axis 603 and resists or prevents undesirable disengagement of wire 105 from connector housing 400. Retention member 1000 is configured to provide insertion opening 2803, which receives the wire 105 and provides a joggle or bend in the wire 105, which provides resistance to pulling and rotation, once the wire 105 is engaged in opening 2803.

Figure 33:
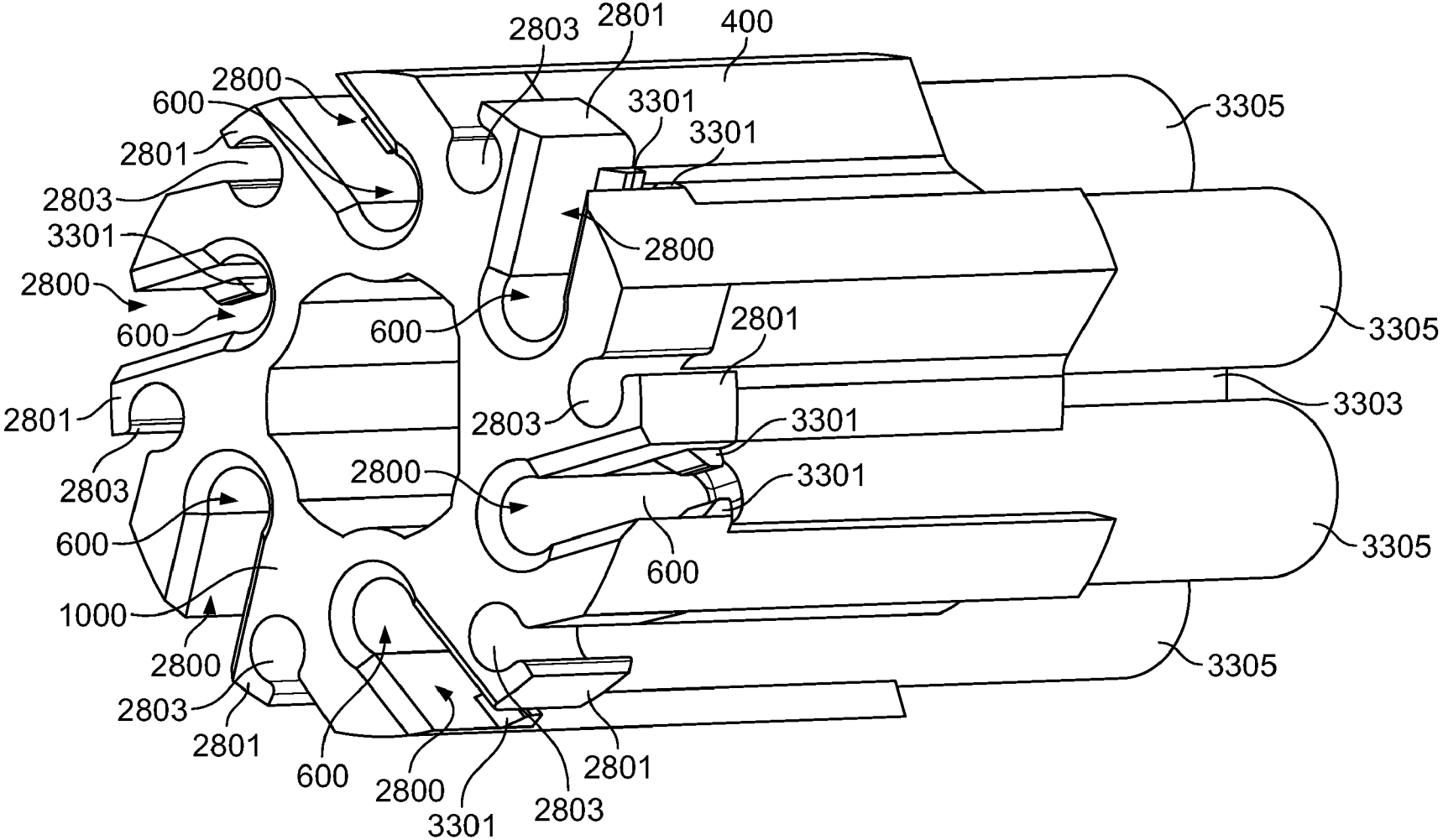
FIG. 33 illustrates a perspective view of a connector housing according to still another embodiment of the present invention.

FIG. 33 illustrates a plug for a wire retaining system according to still another embodiment of the present invention, including a connector housing 400 having a plurality of wire terminals 100 (not shown in FIG. 33) incorporated therein for receiving a plurality of corresponding wires 105 (not shown in FIG. 33). Unless otherwise indicated, placement or orienting of the wire includes the placement or orienting of a portion of the wire, wherein the portion of the wire is preferably an insulated portion of the wire. Specifically, the embodiment shown in FIG. 33 includes six openings 600, corresponding to six wire terminals 100. However, the connector housing 400 may be configured to receive any number of wires 105 in any suitable configuration. For example, although FIG. 33 shows a substantially circular arrangement, the present invention may utilize openings 600 that are arranged in a square, rectangular, oval or other geometry, wherein the holes may be positioned in any configuration, such as circumferentially near an edge or in a matrix arrangement, such as a 3 by 2 matrix.

Connector housing 400 further includes a retention member 1000 formed into the connector housing 400. Retention member 1000 includes a plurality of structures to guide and retain wire 105. Retention member 1000 may be formed into connector housing 400 as a unitary piece or may be attached to connector housing 400. Retention member 1000 includes a plurality of insertion slots 2800. Openings 600 are configured to permit the insertion of wires 105 into the opening and allow a bending of wire 105 into insertion slot 2800. Insertion arms 2801 adjacent insertion slot 2800 provide a structure around which wires 105 may be bent and retained in insertion opening 2803. As shown in FIG. 33, the insertion slot 2800 may include a geometry permitting the "snapping" in of a wire 105 include the insertion opening 2803. The snapping may be provided by elastic deformation or other mechanism of insertion arms 2801 adjacent to insertion slot 2800 wherein the insulation of the wire is received and retained within insertion opening 2803. In addition to insertion opening 2803, the retention member 1000 may further include features 3301, which provide a snapping into place of a wire 105 upon bending after insertion of the wire in a substantially perpendicular direction to the opening center axis 603 (see, e.g., FIG. 34). In order to further secure the wire 105, the wire 105 is further bent and oriented into the insertion opening 2803 (see, e.g., FIG. 34). In addition to the wire retention member 1000, the connector housing 400 includes a connection alignment member 3303 extending the length of the connector housing 400 and having a geometry that mates with a connection alignment opening 3501 (see e.g., FIG. 35). The geometry may be any suitable geometry that provides connecting alignment between connector housings 400. For example, the connection alignment member 3303 and connection alignment opening 3501 may include unidirectional alignment, providing the desired connections with wire 105, wherein the connectors housings 400, 400' only mate upon alignment of the connection alignment member 3303 and connection alignment opening 3501. In one embodiment connection alignment member 3303 and connection alignment opening 3501 are keyed to permit oriented alignment therebetween. In addition, plug members 3305 extend from the connector housing 400 and are configured to be received in plug receptacles 3503 (see e.g., FIG. 35). The plug members 3305 and the plug receptacle 3503 may be any geometry that provides mating and the desired connectivity between connector housings 400, 400'. In addition, plug members 3305 and the plug receptacle 3503 are configured to permit engagement of electrical terminals 100, 100' (not shown in FIG. 33; see e.g., FIG. 37).

Figure 34:
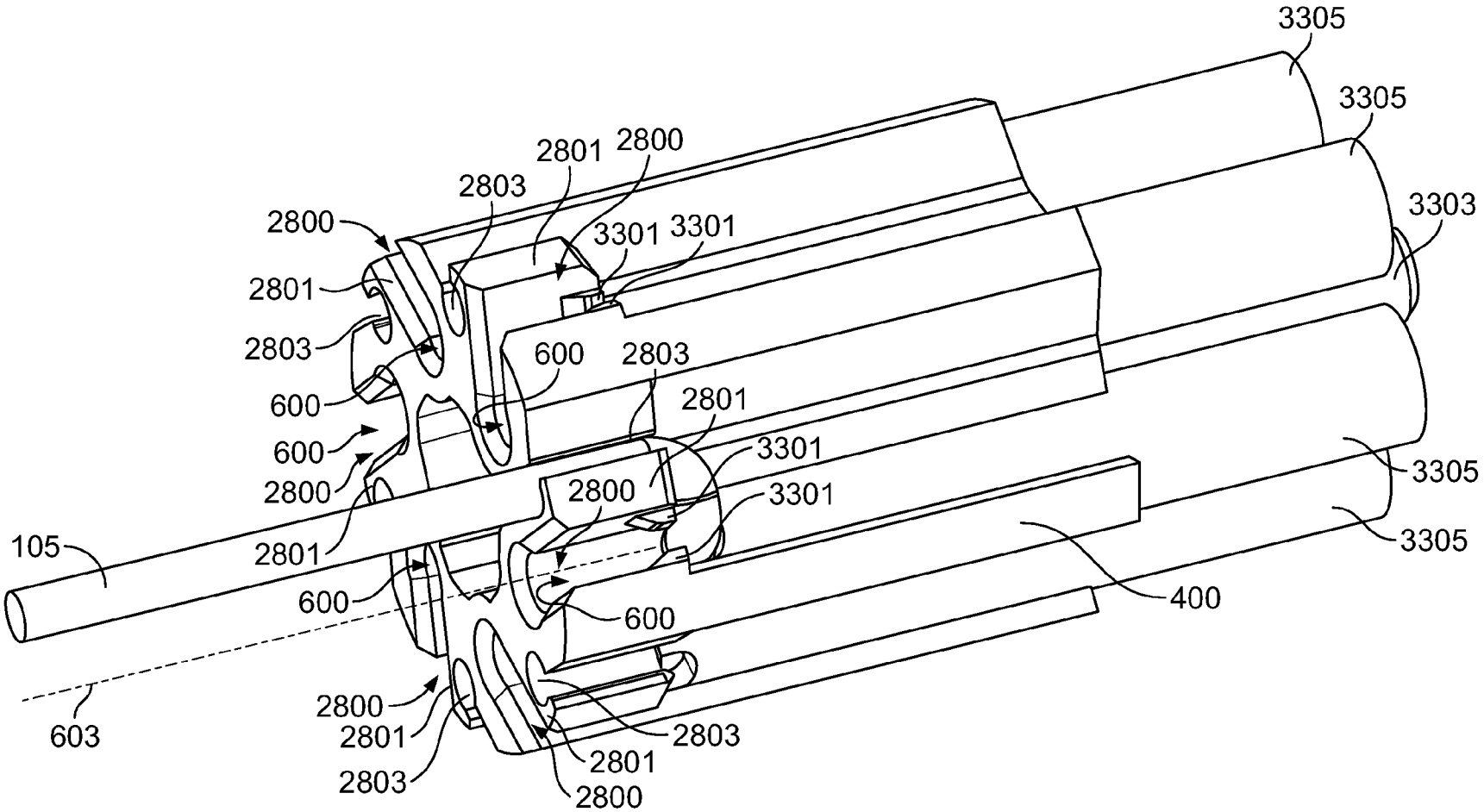
FIG. 34 illustrates a perspective view of a connector housing with a wire installed, according to the embodiment of FIG. 33.

FIG. 34 shows the positioning of a wire 105 into a connector housing 400 according to an embodiment of the present invention. Although a single wire 105 is shown, any number of wires 105 may be utilized. In a preferred embodiment, the number of wires 105 corresponds to the number of openings 600. To install wire 105, the wire 105 is directed along opening axis 603 adjacent retention member 1000 into connector housing 400. Once the wire 105 has engaged electrical connector 100 (see e.g., FIG. 34), the wire 105 is then oriented at a direction substantially perpendicular to the opening center axis 603 and snapped in place by feature 3301. Thereafter, the wire 105 is again oriented in a manner that guides the wire 105 into the insertion slot 2800, wherein the wire 105 is preferably snapped into place by the geometry of the insertion slot 2800, features 3301 and insertion arm 2801. The positioning of the wire 105 in the insertion slot 2803 and around insertion arm 2801 permits wire 105 to be oriented along a plurality of axes (i.e., to have a plurality of bends). These bends provide additional resistance to pulling and/or rotation along the opening center axis 603 and resists or prevents undesirable/unintentional disengagement of wire 105 from connector housing 400.

Figure 35:
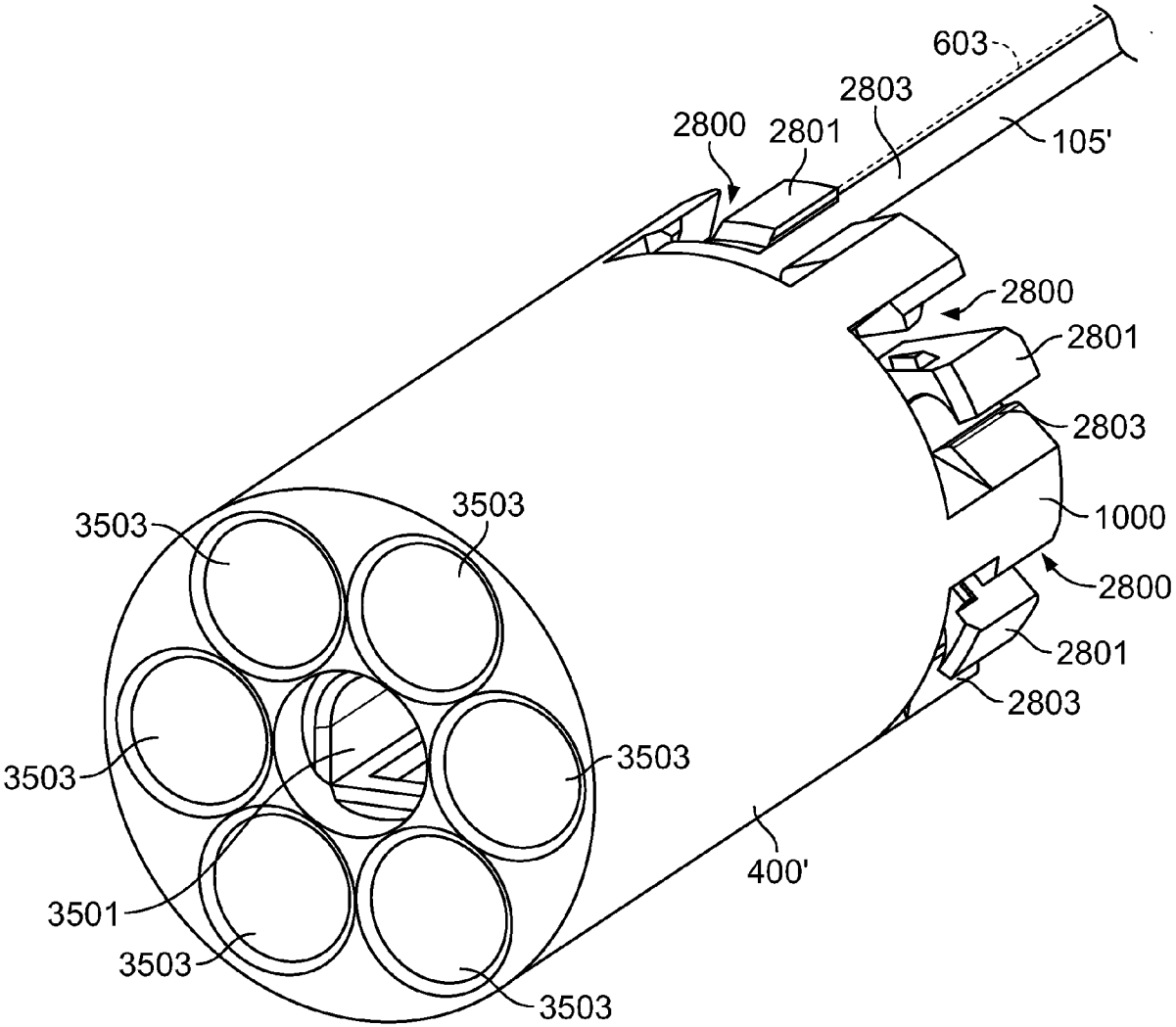
FIG. 35 illustrates a perspective view of a mating connector housing according to still another embodiment of the present invention.

FIG. 35 shows a connector housing 400' according to an embodiment of the present invention configured to receive the connector housing 400 of FIGS. 33-34. As in FIG. 34, the connector housing 400' includes a retention member 1000 having opening 600 (not shown in FIG. 35), insertion slots

2800, insertion arm 2801 and insertion opening 2803, as shown and described above with respect to FIGS. 33 and 34. FIG. 35 is shown with a wire 105' inserted into wire housing 400' and secured into retention member 1000 in a manner similar to FIG. 34. The connector housing 400' includes a connection alignment opening 3501 configured to receive connection alignment member 3303 of connector housing 400. The engagement of the connection alignment member 3303 and the connection alignment opening 3501 may include features, such as latches or detents to provide releasable engagement between connector housing 400 and connector housing 400'. FIG. 35 further includes plug receptacles 3503 which are configured to receive plug members 3305. To provide the conductive portions of the electrical connectors, electrical terminals 100, 100' are inserted into plug receptacles 3503 (see e.g., FIG. 37). The engagement of the plug member 3305 and plug receptacles 3505 provide sufficient alignment to provide releasable engagement and electrical connection between electrical terminal 100 and electrical terminal 100' (see, e.g., FIG. 37).

Figure 36:
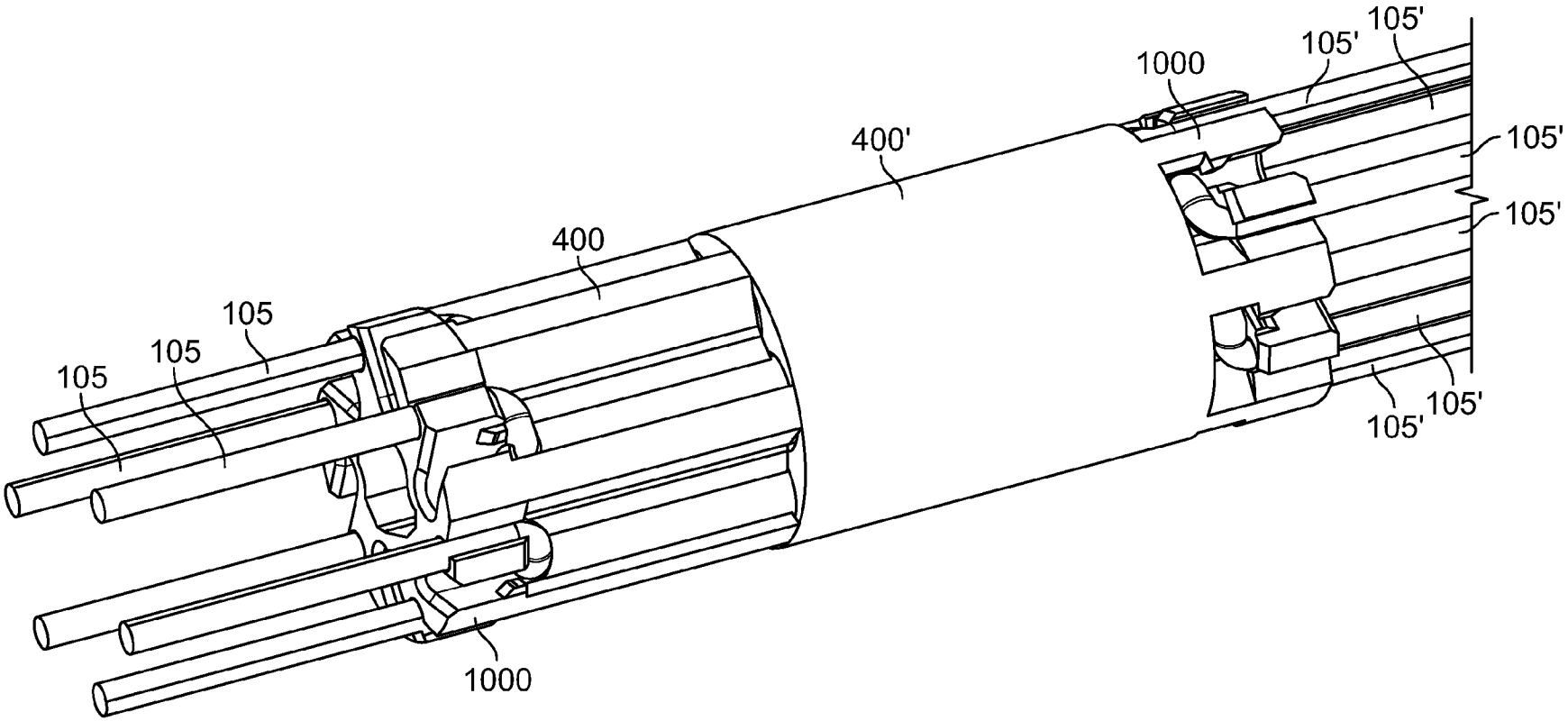
FIG. 36 illustrates a perspective view of a connector system according to still another embodiment of the present invention.

FIG. 36 shows a connector system according to an embodiment of the present invention includes a connector housing 400 in releasable engagement with a connector housing 400'. The system includes six wires engaged in the retention members of respective ends of each of connector housing 400 and connector housing 400'. The connector system provides electrical connection between the wires 105' entering connector housing 400' and the wires 105 entering connector housing 400.

Figure 37:
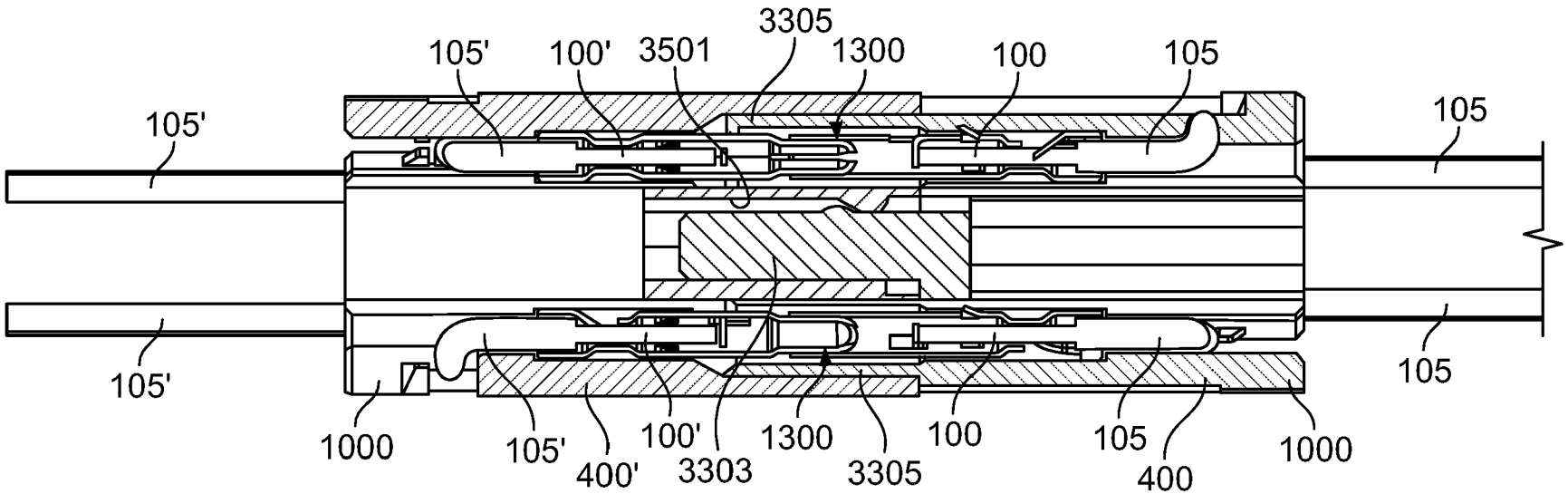
FIG. 37 illustrates an elevational cross-sectional view two connector housings in an engaged position according to still another embodiment of the present invention.

FIG. 37 illustrates a cross-sectional view of connector housing 400 engaged with a second connector housing 400', wherein the wire 105 and wire terminal 100,100' are shown in elevational cross-sectional view. The connection of connector housings 400 and 400' permits the electrical connection of wire 105 with wire 105' by electrical communication between wire terminal 100 and 100' at junction 1300. Junction 1300 preferably includes coupling of a male plug with a female connection, each corresponding to one of connector housing 400 or connector housing 400'. The engagement of connector housing 400 to connector housing 400' takes place by engagement of disenagable connection of alignment member 3303 and connection alignment opening 3501 connecting connector housings 400 and 400'.

In a preferred embodiment, the wire retention of wires 105 is sufficient that forces on wire 105, 105' provide for disengagement of connection alignment member 3303 and connection alignment opening 3501 at a lesser force than the force required to disengage wires 105, 105' from connector housing 400, 400'.

The embodiment shown in FIGS. 33-37 further includes a wire retention member 1000 that is configured with six insertion arms 2801 each having an insertion slot 2800 and an insertion opening 2803. While the embodiment shown in FIGS. 33-37 show structures, including the insertion arms 2801, insertion slot 2800 and insertion opening 2803, corresponding to six openings 600, structures corresponding to any number of openings 600 may be used.

Figure 38:
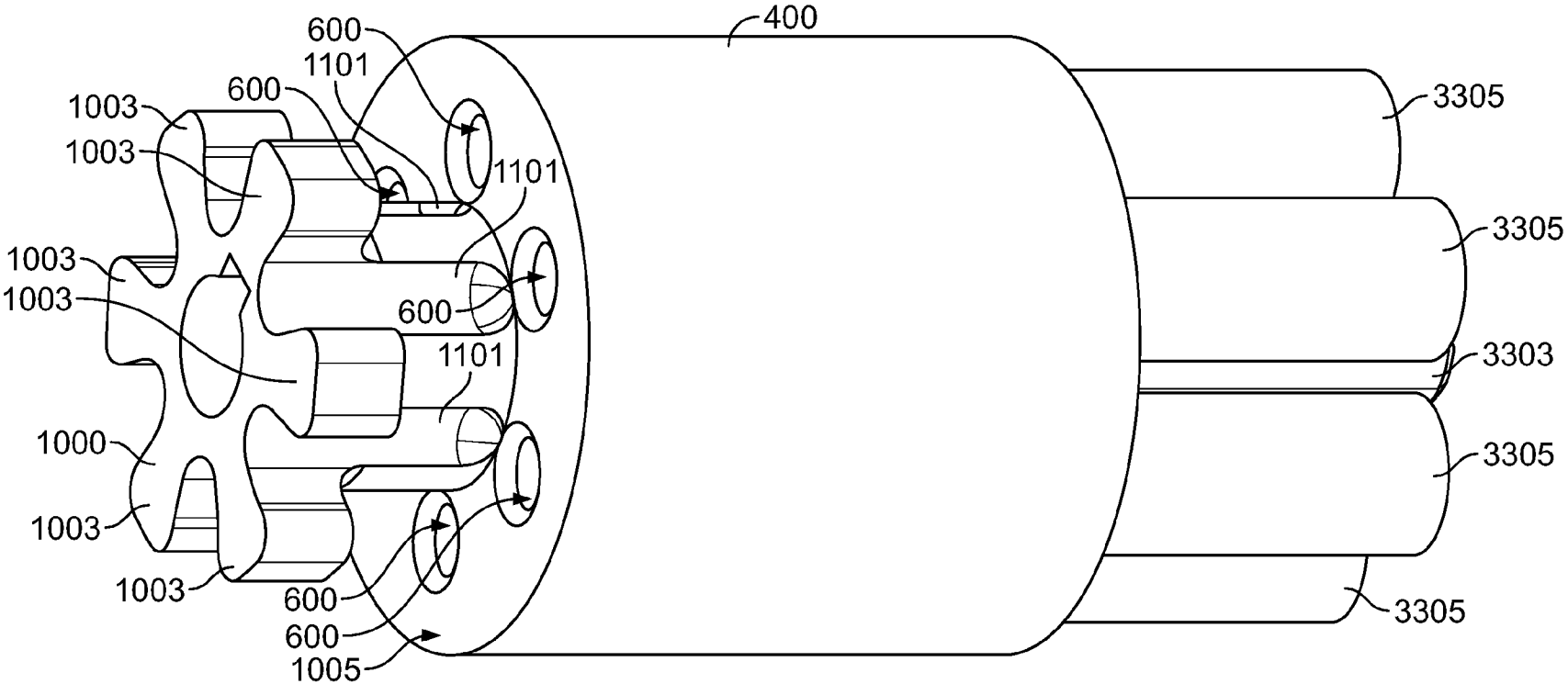
FIG. 38 illustrates a perspective view of a connector housing according to still another embodiment of the present invention.

FIG. 38 illustrates a plug for a wire retaining system according to still another embodiment of the present invention, including a connector housing 400 having a plurality of wire terminals 100 (not shown in FIG. 38) incorporated therein for receiving a plurality of corresponding wires 105 (not shown in FIG. 38). As shown and described with respect to the embodiment of FIGS. 33-37, the embodiment shown in FIG. 38 includes six openings 600, corresponding to six wire terminals 100.

Connector housing 400 further includes a retention member 1000 extending from connector housing 400. Retention member 1000 includes a plurality of arms 1003 separated by a wire guide 1101 to guide and retain wire 105. Arms 1003 are configured to provide a slot 1005. Slot 1005 has a geometry permitting the insertion of a wire or cable tie 1201 (see e.g., FIG. 41), or other device capable of substantially immobilizing wires 105. Retention member 1000 may be formed into connector housing 400 as a unitary piece or may be attached to connector housing 400. The wire guides 1101 include cavities, channels or indentations formed in the body of the retention member 1000. The wire guides 1101 are configured with a surface that receives wire 105 in a manner that provides a bend in wire 105 in the installed position, wherein the rotation of the wire 105 is minimized or eliminated. In order to further secure the wire 105, the wire 105 is further bent and oriented into the wire guide 1101 (see, e.g., FIGS. 39-40). Thereafter, a cable tie or similar device is positioned around wires 105, wherein the wires are then bent and/or guided into an installed position along the surface of wire guide 1101 of retention member 1000. In addition to the wire retention member 1000, the connector housing 400 includes a connection alignment member 3303 as shown and described above with respect to FIG. 33.

Figure 39:
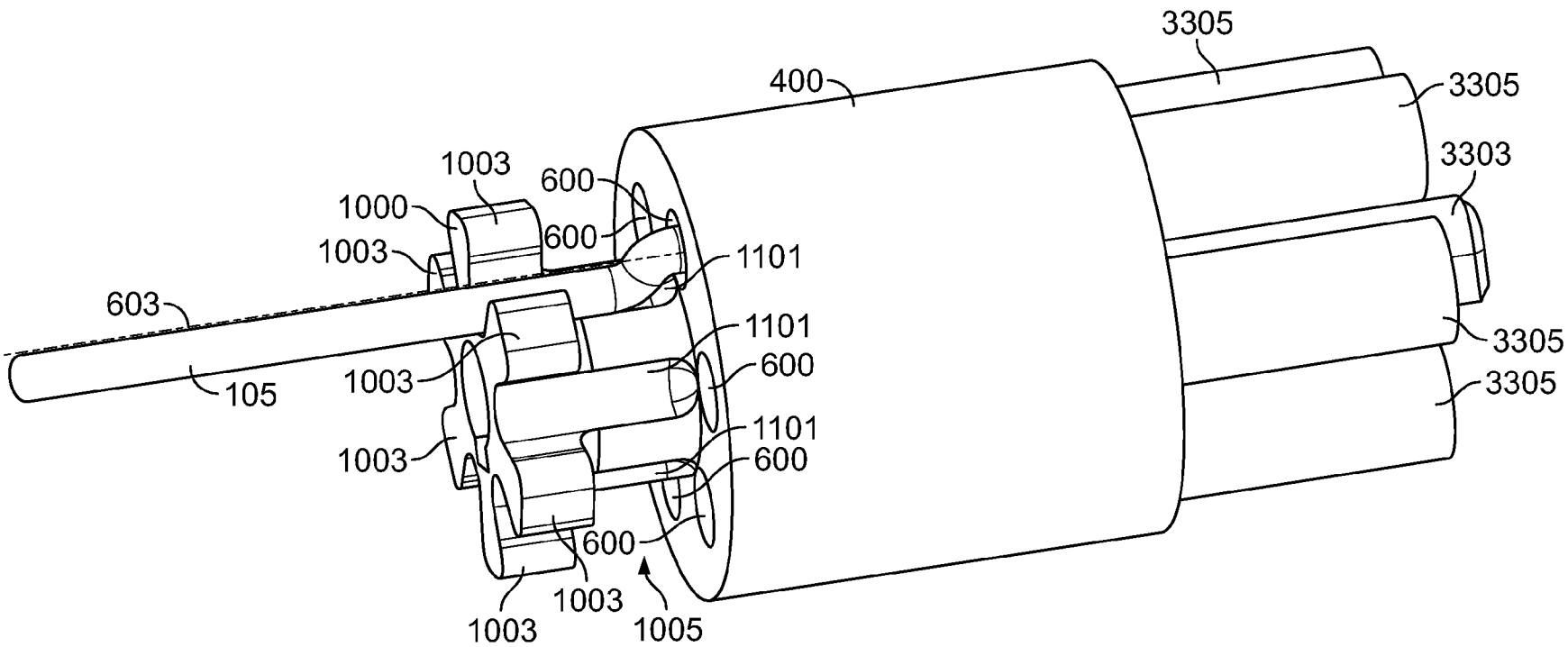
FIG. 39 illustrates a perspective view of a connector housing with a wire installed, according to the embodiment of FIG. 38.
Figure 41:
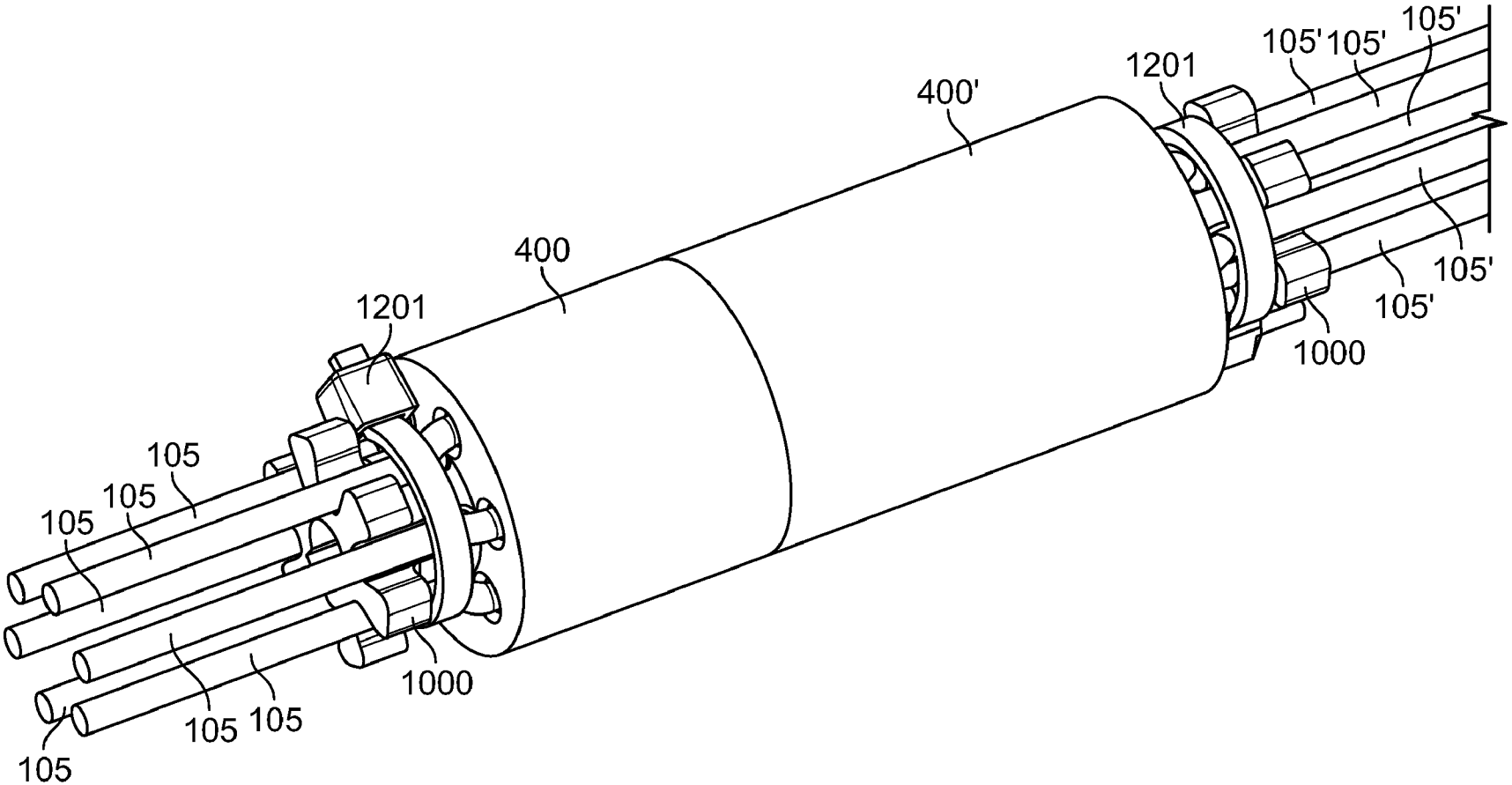
FIG. 41 illustrates a perspective view of a connector system according to still another embodiment of the present invention.

FIG. 39 shows the positioning of a wire 105 into a connector housing 400 according to an embodiment of the present invention. As in the embodiment shown in FIG. 33-37, although one wire 105 is shown, any number of wires 105 may be utilized. To install wire 105, the wire 105 is directed along opening axis 603 past retention member 1000 into connector housing 400. Once the wire 105 has engaged electrical connector 100 (see e.g., FIG. 37), the wire 105 is positioned into wire guide 1101 and then a cable tie 1201 (see FIG. 41) is positioned (i.e., "looped") around the wires 105 as shown in FIG. 41. Alternatively, a cable tie 1201 is positioned around wires 105, wherein the diameter of the loop of the cable tie 1201 may reduced (i.e., pulled tight) to urge wires 105 into position in the wire guide 1101 at an angle to opening center axis 603. The positioning of the wires 105 in the wire guide 1101 provides a bend or joggle in wire 105. The bends in wire 105 provide addition resistance to pulling and/or rotation along the opening center axis 603 and resists or prevents undesirable/unintentional disengagement of wire 105 from connector housing 400.

Figure 40:
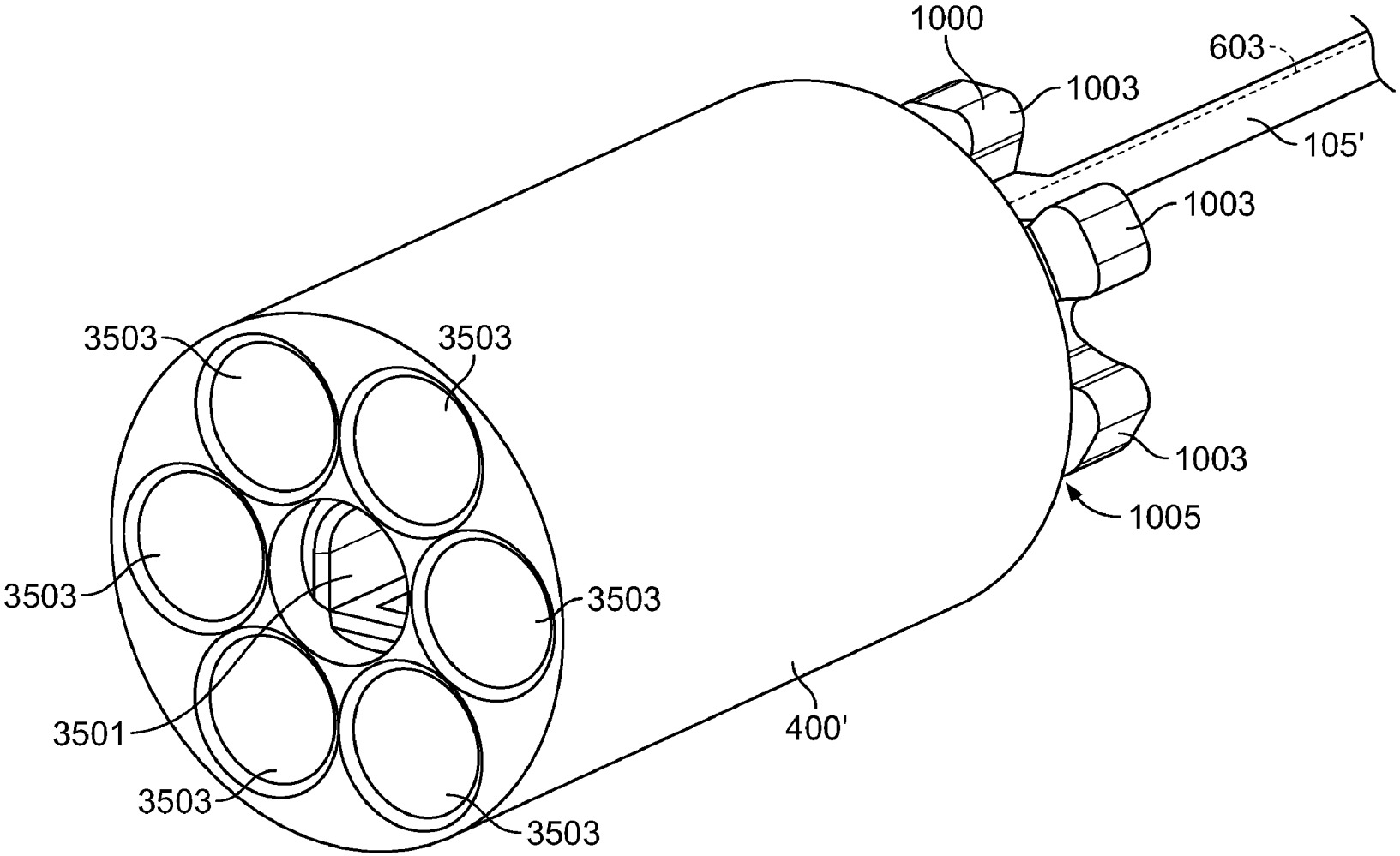
FIG. 40 illustrates a perspective view of a mating connector housing according to still another embodiment of the present invention.

FIG. 40 shows a connector housing 400' according to an embodiment of the present invention configured to receive the connector housing 400 of FIGS. 38-39. As in FIG. 38, the connector housing 400' includes a retention member 1000 having opening 600 (not shown in FIG. 40), arms 1003 and wire guide 1101 (not shown in FIG. 40), as shown and described above with respect to FIGS. 38 and 39. FIG. 41 is shown with a wire 105' inserted into wire housing 400' and secured into retention member 1000. The connector housing 400' includes a connection alignment opening 3501 configured to receive connection alignment member 3303, as shown and described with respect to FIGS. 33-37.

FIG. 41 shows a connector system according to an embodiment of the present invention includes a connector housing 400 in releasable engagement with a connector housing 400'. The system includes six wires 105 engaged in the retention members 1000 of respective ends of each of connector housing 400 and connector housing 400' wherein cable ties 1201 are positioned around wires 105, 105' to maintain the joggle in each of the wires 105 and to retain their position in wire guide 1101. The connector system provides electrical connection between the wires 105 entering connector housing 400' and the wires 105 entering connector housing 400.

Figure 42:
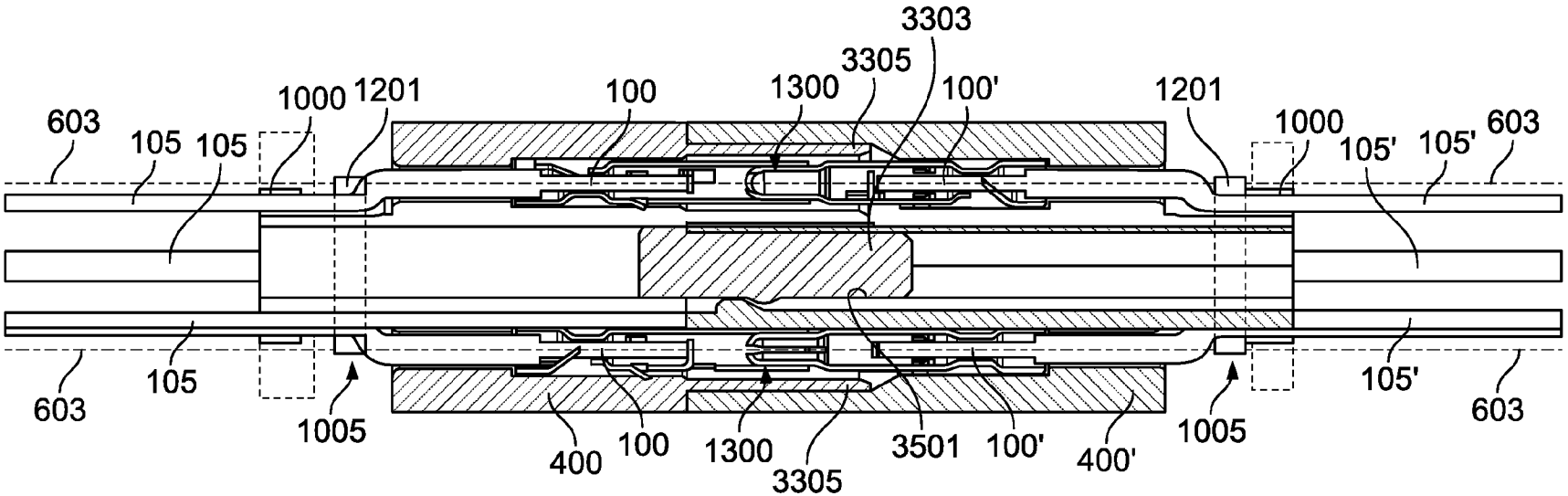
FIG. 42 illustrates an elevational cross-sectional view two connector housings in an engaged position according to still another embodiment of the present invention.

FIG. 42 illustrates a connector housing 400 engaged with a second connector housing 400'. Connector housing 400 and connector housing 400' are engaged in the manner shown and described above with respect to FIG. 37. As shown, wire 105, 105' is positioned within side opening slot 1005 of wire retention member 1000. The bend in each of wires 105, 105' adjacent to retention member 1000 provide resistance to or prevention of unintentional disengagement of wire 105, 105' resulting from rotation and/or in response to a pulling force directed along opening center axis 603.

In a preferred embodiment, the wire retention of wires 105 is sufficient that forces on wire 105, 105' provide for disengagement of connection alignment member 3303 and connection alignment opening 3501 at a lesser force than the force required to disengage wires 105, 105' from connector housing 400, 400'.

The embodiment shown in FIGS. 38-42 further includes a wire retention member 1000 that is configured with six insertion arms 2801 having an insertion slot 2800 and an insertion opening 2803. While the embodiment shown in FIGS. 38-42 show structures, including the arms 1003 and slot 1005, corresponding to six openings 600, structures corresponding to any number of openings 600 may be used.

As further shown in FIG. 42, cable tie 1201 may be positioned in slot 1005, adjacent wire 105. The cable tie 1201 provides force against wire 105 and retention member 1000 (i.e., urging wire 105 into physical contact with retention member 1000). The force provided by cable tie 1201 provides resistance to or prevention of unintentional disengagement of wire 105 in response to a rotational or pulling force directed along opening center axis 603.

While the above has described embodiments of wire retention structures, components and methods, the present invention is not limited to the embodiments described above. In particular, the present invention may include a single wire retention member 1000, component or method or may include a combination of a plurality of structures, components and methods. For example, a connector according to an embodiment of the present invention may include an wire terminal 100 having a blade 117, may include angle channel 501, ribs 601, segmenting slot 700, fingers 801, wire retention member 1000 and any combinations thereof. The various structures are not limited to those structures shown and may include additional channels, slots, grooves or other features for retaining a wire 105 adjacent thereto. In addition, devices such as cable ties 1201, which can be of unitary construction with connection housing 400, may be used in combination with the wire retention member 1000 to further provide resistance to unintentional disengagement due to pulling and/or rotation.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A wire retaining connector comprising:

a connector body having at least one opening configured to receive a wire, the wire including a partially exposed conductor and insulation, the connector body further comprising a wire retention member having at least one slot into which a portion of the wire may be positioned, wherein the positioning of the portion of the wire provides at least one bend in the wire sufficient to resist rotation and disconnection of the wire from the connector body, the connector body further includes a wire terminal configured to receive the wire along an axis and at least a portion of insulation surrounding a conductive portion of the wire, the wire terminal having a blade arranged to contact the insulation; wherein the blade forms a channel in the insulation during insertion of the wire into the terminal, the channel sufficiently engaging the blade to substantially resist rotational movement between the wire and the wire terminal.

2. The connector of claim 1, wherein the blade includes a taper arranged parallel to the axis to reduce the force required to insert the wire and form the channel.

3. The connector of claim 1, wherein the wire retention member is formed into the connector body.

4. The connector of claim 3, wherein the wire retention member includes a plurality of arms forming an insertion slot into which the portion of the wire may be retained.

5. The connector of claim 1, wherein the wire retention member is fabricated from a material capable of elastic deformation to provide a snapping of the portion of the portion of the wire into or out of the slot.

6. The connector of claim 1, wherein the wire retention member includes features that resist disengagement of the portion of the wire.

7. The connector of claim 1, wherein the wire retention member is formed into the connector body.

8. The connector of claim 1, wherein the connector body has a plurality of opening and the wire retention member has a plurality of slots.

9. The connector of claim 1, wherein the connector body has six openings and the wire retention member has at least six slots.

10. A wire retaining connector comprising:

a connector body having at least one receiving opening configured to receive a wire, the wire including a partially exposed conductor and insulation, the connector body further comprising a wire retention member having at least one slot into which a portion of the wire may be positioned, at least one insertion arm adjacent the slot and an insertion opening wherein the wire is inserted through the slot and into the receiving opening and terminated to an electrical connector located in the connector body, and at least a portion of the wire is moved out of the slot around the insertion arm and into the insertion opening, wherein the positioning of the portion of the wire in the insertion opening and around the insertion arm provides bends in the wire sufficient to resist rotation and disconnection of the wire from the connector body.

11. The connector of claim 10, wherein the connector body further includes a wire terminal configured to receive the wire along an axis and at least a portion of insulation surrounding a conductive portion of the wire, the wire terminal having a blade arranged to contact the insulation; wherein the blade forms a channel in the insulation during insertion of the wire into the terminal, the channel sufficiently engaging the blade to substantially resist rotational movement between the wire and the wire terminal.

12. The connector of claim 11, wherein the blade includes a taper arranged parallel to the axis to reduce the force required to insert the wire and form the channel.

13. The connector of claim 10, wherein the wire retention member extends from a surface of the connector body.

14. The connector of claim 13, wherein the wire retention member includes a plurality of retention arms radially spaced to provide spacing of a plurality of wires.

15. The connector of claim 10, wherein the connector body has a plurality of receiving openings and the wire retention member has a plurality of slots.

16. The connector of claim 10 wherein the connector body has six receiving openings and the wire retention member has six slots.

17. A wire retention connector comprising:

a connector body having a wire retention member having at least one surface with which a portion of a wire may be positioned in close proximity or in physical contact, wherein the positioning of the portion of the wire provides at least one bend in the wire sufficient to resist rotation and disconnection of the wire from the connector body;

the connector body further includes a wire terminal configured to receive the wire along an axis and at least a portion of insulation surrounding a conductive portion of the wire, the wire terminal having a blade arranged to contact the insulation; wherein the blade forms a channel in the insulation during insertion of the wire into the terminal, the channel sufficiently engaging the blade to substantially resist rotational movement between the wire and the wire terminal.

18. The connector system of claim 17, wherein the surface includes a plurality of slots formed into the wire retention member.

19. The connector system of claim 17, wherein the surface includes a plurality of channels formed into the wire retention member.

* * * * *